US005576133A

United States Patent [19]

Baba et al.

[11] Patent Number: 5,576,133

[45] Date of Patent: Nov. 19, 1996

[54] CARRIER FOR USE IN ELECTROPHOTOGRAPHY, TWO COMPONENT-TYPE DEVELOPER AND IMAGE FORMING METHOD

[75] Inventors: Yoshinobu Baba; Takeshi Ikeda, both of Yokohama; Yasuko Amano, Ebina; Hitoshi Itabashi, Yokohama, all of Japan

[73] Assignee: Canon Kabushiki Kaisha, Tokyo, Japan

[21] Appl. No.: 502,182

[22] Filed: Jul. 13, 1995

Related U.S. Application Data

[63] Continuation of Ser. No. 93,957, Jul. 21, 1993, abandoned.

[30] Foreign Application Priority Data

| | | | |
|---|---|---|---|
| Jul. 22, 1992 | [JP] | Japan | 4-195501 |
| Jul. 22, 1992 | [JP] | Japan | 4-195505 |
| Jul. 22, 1992 | [JP] | Japan | 4-195506 |
| Jul. 28, 1992 | [JP] | Japan | 4-201394 |

[51] Int. Cl.[6] ..... G03G 9/107

[52] U.S. Cl. ..... 430/106.6; 430/108; 430/122; 252/62.58; 252/62.63

[58] Field of Search ..... 430/108, 106.6, 430/122; 252/62.58, 62.63

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 4,267,247 | 5/1981 | Ziola et al. | 430/108 |
| 4,598,034 | 7/1986 | Honjo et al. | 430/108 |
| 4,600,675 | 7/1986 | Iwasa et al. | 430/106.6 |
| 4,623,603 | 11/1986 | Iimura et al. | 430/106.6 |
| 4,855,205 | 8/1989 | Saha et al. | 430/106.6 |
| 5,104,761 | 4/1992 | Saha et al. | 430/106.6 |
| 5,106,714 | 4/1992 | Saha et al. | 430/106.6 |
| 5,246,609 | 9/1993 | Nakata et al. | 252/62.58 |
| 5,268,249 | 12/1993 | Saha et al. | 430/106.6 |
| 5,358,660 | 10/1994 | Kidoh et al. | 252/62.58 |

FOREIGN PATENT DOCUMENTS

| | | |
|---|---|---|
| 0142731 | 5/1985 | European Pat. Off. . |
| 59-104663 | 6/1984 | Japan . |
| 2-88429 | 3/1990 | Japan . |
| 4-3868 | 1/1992 | Japan . |

OTHER PUBLICATIONS

Database WPI, Week 9043, Derwent Publ., AN 90–323347 (43) of JP 2–223962, Sep. 6, 1990.

*Primary Examiner*—Christopher D. Rodee

*Attorney, Agent, or Firm*—Fitzpatrick, Cella, Harper & Scinto

[57] ABSTRACT

A two component-type developer for electrophotography showing improved electrophotographic performances and also free from carrier adhesion (undesirable carrier transfer to the photosensitive member and recording materials) is constituted by using a magnetic carrier of 5–100 μm in particle size. The carrier has a bulk density of at most 30 g/cm$^3$, and magnetic properties including: a magnetization of 30–150 emu/cm$^3$ under a magnetic field strength of 1000 oersted, a magnetization (residual magnetization $\sigma_r$) of at least 25 emu/cm$^3$ under a magnetic field strength of zero oersted, a coercive force of less than 300 oersted, and a relationship of:

$$|\sigma_{1000}-\sigma_{300}|/\sigma_{1000} \leqq 0.40$$

wherein $\sigma_{1000}$ and $\sigma_{300}$ denote magnetizations under magnetic field strength of 1000 oersted and 300 oersted, respectively.

58 Claims, 12 Drawing Sheets

CARRIER FOR USE IN ELECTROPHOTOGRAPHY, TWO COMPONENT-TYPE DEVELOPER AND IMAGE FORMING METHOD

This application is a continuation-in-part, of application Ser. No. 08/093,957 filed Jul. 21, 1993, now abandoned.

FIELD OF THE INVENTION AND RELATED ART

The present invention relates to a carrier for use in electrophotography to be mixed with a toner to constitute a developer for developing an electrostatic latent image, a two component-type developer containing the carrier, and an image forming method using the developer.

Hitherto, various electrophotographic processes have been disclosed in U.S. Pat. Nos. 2,297,691; 3,666,363; 4,071,361; etc. In these processes, an electrostatic latent image is formed on a photoconductive layer by irradiating a light image corresponding to an original, then, in case of normal development, colored fine particles, called a toner, having a polarity of charge opposite to that of the latent image is attached onto the latent image to develop the latent image. Subsequently, the resultant toner image is, after being transferred onto a transfer material such as paper or a synthetic resin film, as desired, fixed, e.g., by heating, pressing, or heating and pressing, or with solvent vapor to obtain a copy.

In the step of developing the latent image, toner particles charged to a polarity opposite to that of the latent image is attracted by electrostatic force to be caused to attach onto the latent image (alternatively, in case of reversal development, toner particles having a triboelectric charge of the same polarity as that of the latent image is used). In general, methods for developing an electrostatic latent image with a toner can be classified into a developing method using a two component-type developer constituted by mixing a small amount of a toner with carrier and a developing method using a monocomponent-type developer constituted by a toner alone without containing a carrier.

The electrophotographic processes have reached a satisfactory level for use in document copying but are still desired be improved, e.g., so as to provide a further high image quality. For example, electrophotographic processes for providing a full-color image are still tried to be improved in image quality or quality level by various means including digital image processing and alternating electric field application at the time of development in view of progresses in computer technology, high definition television technology, etc.

Heretofore, the two component-type developer has been used for providing a full-color image. Generally, the carrier constituting the two component-type developer may be classified into a conductive carrier represented by iron powder and an insulating carrier formed by coating the surface of particles of, e.g., iron powder, nickel powder or ferrite powder with an insulating resin. When an alternating electric field is applied in order to obtain a high image quality, a charge is leaked out through a carrier to decrease a latent image potential if the carrier has a low resistivity, thus failing to provide a good developed image. Accordingly, a carrier is required to have at least a certain level of resistivity. In case where a carrier core is conductive, the carrier core is preferably coated. A ferrite having a high resistivity to a certain extent has been preferred as a core material.

In general, since the iron powder has strong magnetism, a magnetic brush formed by a developer containing the iron powder carrier is hardened in a region for developing a latent image with a toner contained in the developer, thus causing a brush image or a coarse image. As a result, it is difficult to obtain a high quality-developed image. Therefore, a ferrite has been preferably used also in order to provide a high quality image by lowering a magnetic force of a carrier used.

In order to form a high quality image, it has been proposed to use a carrier having saturation magnetization of at most 50 emu/cm$^3$ so as to provide good developed images free from brush images in Japanese Laid-Open Patent Application (JP-A) 59-104863. In this instance, as the value of saturation magnetization of the carrier is gradually lowered, a better thin-line reproducibility is obtained but on the other hand, there is noticeably observed a phenomenon that the carrier is transferred and adheres to an electrostatic latent image bearing member such as a photosensitive drum as the carrier leaves away from a magnetic pole (hereinafter, referred to as "carrier adhesion") becomes noticeable.

JP-B 4-3868 has disclosed a hard ferrite carrier having a coercive force of at least 300 G(gauss). However, when such a lard ferrite carrier is used, a developing device including the hard ferrite carrier is unavoidably enlarged in size. In order to realize a small-sized high quality color copying machine, it is preferable that a developer-carrying member using a fixed magnetic core is used. In this case, the above-mentioned hard ferrite carrier having a high coercive force has caused a problem of poor carrying (or conveying) characteristic due to its self-agglomeration property.

Further, JP-A 2-88429 has disclosed a hard ferrite carrier having a spinel structure phase and a magnetoplumbite structure phase containing a lanthanoid series element. This carrier, however, in addition to the above-mentioned problem, has a disadvantage of disturbing a development condition in a developing system wherein an alternating electric field for providing a high quality image is applied since the carrier has electrical conductivity and thus a charge is leaked out through the carrier.

Accordingly, it is important that the carrier used, in the developing system using an alternating electric field has at least a certain level of resistivity.

As described above, it is desired to provide a carrier for use in electrophotography capable of providing a high quality image, particularly an image with a good reproducibility at a highlight part, while suppressing carrier adhesion.

SUMMARY OF THE INVENTION

A generic object of the present invention is to provide a carrier for use in electrophtography, a two component-type developer and an image forming method having solved the above-mentioned problems.

A more specific object of the present invention is to provide a carrier for use in electrophotography, a two component-type developer and an image forming method capable of effecting a development faithful to an original, i.e., a latent image.

Another object of the present invention is to provide a carrier for use in electrophtography, a two component-type developer and an image forming method excellent in resolution, reproducibility at a highlight part, and thin-line reproducibility.

Another object of the present invention is to provide a carrier for use in electrophotography, a two component-type developer and an image forming method capable of providing a high quality developed image without causing carrier adhesion even in development under an alternating electric field.

A further object of the present invention is to provide a carrier for use in electrophotography, a two component-type developer and an image forming method capable of being applicable to a small-sized developing device using a fixed magnetic core-type developer-carrying member for obtaining a high quality image.

A still further object of the present invention is to provide a carrier for use in electrophotography, a two component-type developer and in image forming method capable of retaining a high quality image free from a deterioration in image quality even in copying test on a large number of sheets.

According to the present invention, there is provided a carrier for use in electrophotography, comprising carrier particles having an average particle size of 5–100 μm, wherein the carrier has a bulk density of at most 3.0 g/cm$^3$ and magnetic properties including: a magnetization of 30–150 emu/cm$^3$ under a magnetic field strength of 1000 oersted, a magnetization (residual magnetization $\sigma_r$) of at least 25 emu/cm$^3$ under a magnetic field strength of zero oersted, a coercive force of less than 300 oersted, and a relationship of:

$$|\sigma_{1000}-\sigma_{300}|/\sigma_{1000} \leqq 0.40$$

wherein $\sigma_{1000}$ and $\sigma_{300}$ denote magnetizations under magnetic field strength of 1000 oersted and 300 oersted, respectively.

According to the present invention, there is further provided a two component-type developer for developing an electrostatic image, comprising a toner and a carrier, the carrier comprising carrier particles having an average particle size of 5–100 μm, wherein the carrier has a bulk density of at most 3.0 g/cm$^{TM}$ and magnetic properties including: a magnetization of 30–150 emu/cm$^3$ under a magnetic field strength of 1000 oersted, a magnetization (residual magnetization $\sigma_r$) of at least 25 emu/cm$^3$ under a magnetic field strength of zero oersted, a coercive force of less than 300 oersted, and a relationship of:

$$|\sigma_{1000}-\sigma_{300}|/\sigma_{1000} \leqq 0.40$$

wherein $\sigma_{1000}$ and $\sigma_{300}$ denote magnetizations under magnetic field strength of 1000 oersted and 300 oersted, respectively.

According to the present invention, there is further provided an image forming method, comprising:

conveying a two component-type developer comprising a toner and a magnetic carrier carried on a developer-carrying member to a developing station, and forming a magnetic brush of the developer in a magnetic field formed by a developing magnetic pole disposed inside the developer carrying member at the developing station and causing the magnetic brush to contact an electrostatic latent image held on a latent image-bearing member, thereby developing the electrostatic latent image to form a toner image;

wherein the carrier comprises carrier particles having an average particle size of 5–100 μm, an the carrier has a bulk density of at most 3.0 g/cm$^3$, and magnetic properties including: a magnetization of 30–150 emu/cm$^3$ under a magnetic field strength of 1000 oersted, a magnetization (residual magnetization $\sigma_r$) of at least 25 emu/cm$^3$ under a magnetic field strength of zero oersted, a coercive force of less than 300 oersted, and a relationship of:

$$|\sigma_{1000}-\sigma_{300}|/\sigma_{1000} \leqq 0.40$$

wherein $\sigma_{1000}$ and $\sigma_{300}$ denote magnetizations under magnetic field strength of 1000 oersted and 300 oersted, respectively.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
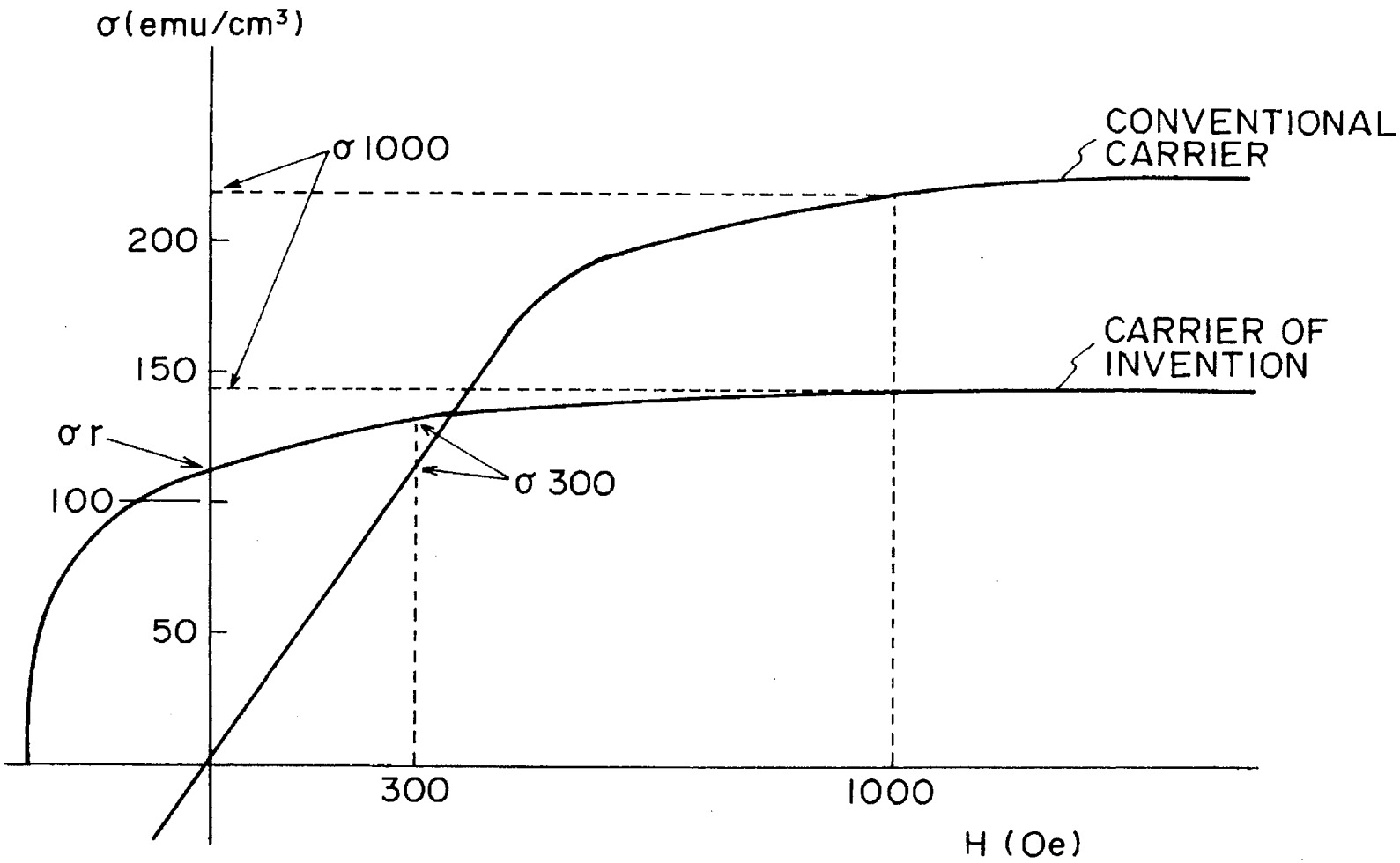
FIG. 1 is a graph showing magnetic characteristic curves (magnetization curves) of carriers plotted with an external magnetic field (oersted) on the abscissa and with a magnetization per unit volume of the carriers on the ordinate.

The reasons why the carrier according to the present invention can solve the above-mentioned problems of the conventional carriers and can effect development faithful to an original (i.e., a latent image) while suppressing carrier adhesion, may be considered as follows.

In order to effect development faithful to a latent image, it is important to provide a magnetization (intensity) of 30–150 emu/cm$^3$ to the carrier at a developing magnetic pole under application of a magnetic field. In general, the strength of the magnetic field at the developing magnetic pole is about 1000 oersted (Oe). In this instance, if the carrier is caused to have a relatively small magnetization (i.e., 30–150 emu/cm$^3$), a magnetic brush of a developer containing the carrier becomes shorter, denser and softer to allow the above-mentioned development faithful to the latent image. Particularly, in case where an alternating electric field vibrating the developer is applied to a developing station to effect development, the developing efficiency is improved to achieve a very faithful development since the magnetic brush becomes shorter, denser and softer as described above. The reason why the carrier of the present invention can prevent deterioration of image quality and allow maintenance of high-quality images as obtained at the initial stage for a long period, may be attributable to the characteristics that a two component-type developer containing such a carrier having a weak magnetization, when applied onto a developing sleeve enclosing a fixed magnet, provides soft carrier brushes exerting a weak magnetic field to each other in the neighborhood of the regulating member and thus not exerting a substantial shear to the toner.

As a result of further study, it has been found that the carrier adhesion is liable to occur in a magnetic field of 0–300 oersted and, if the carrier magnetization at that time is sufficiently high up to a certain level, the carrier adhesion is not caused or not readily caused. The carrier adhesion is also affected by the developing bias condition and is more readily caused in the case of development under application of an alternating magnetic field than a DC electric field when the carrier has a charge so that a magnetic force is required in order to retain the carrier on the developing sleeve. Accordingly, the above-mentioned level of magnetization under electric field is required for suppressing the carrier adhesion. In the present invention, as shown by a magnetization curve shown in FIG. 1, a carrier showing an increased magnetization under 0–300 oersted while showing a lower magnetization at 1000 oersted $\sigma_{1000}$ of 30–150 emu/cm$^3$ compared with that of a conventional carrier is used to prevent the carrier adhesion while obtaining high quality images.

A magnetic material having a large residual magnetization is generally a material also showing a large coercive force like a hard ferrite used for a permanent magnet. Further, a carrier showing a large residual magnetization is liable to show a poor mixing characteristic with a toner and cause a failure in conveyance of the developer due to its self-agglomerating characteristic, thus requiring a large-sized special developing device including a developer-carrying member equipped with a rotary magnetic core applicator.

In the present invention, a carrier showing a coercive force of less than 300 oersted is used instead of a conventional hard magnetic material, so that the carrier shows a good mixing characteristic with a toner even in a small-sized developing device equipped with a fixed core-type developer-carrying member and provides a developer showing a good conveyance characteristic.

The carrier used in the present invention comprises carrier particles showing the following magnetic properties.

The carrier particles are required to show a magnetization ($\sigma_{1000}$) of 30–150 emu/cm$^3$ at 1000 oersted after magnetic saturation (by applying a magnetic field of 10 k Oe). For further improved image quality, a range of 30–120 emu/cm$^3$ is prepared. Above 150 emu/cm$^3$ the resultant density of the developing is not very different from that of the conventional brush, so that it becomes difficult to obtain high-quality toner images. Below 30 emu/cm$^3$, the magnetic constraint force at 0–300 oersted is decreased so that the carrier adhesion is liable to be caused.

Figure 2:
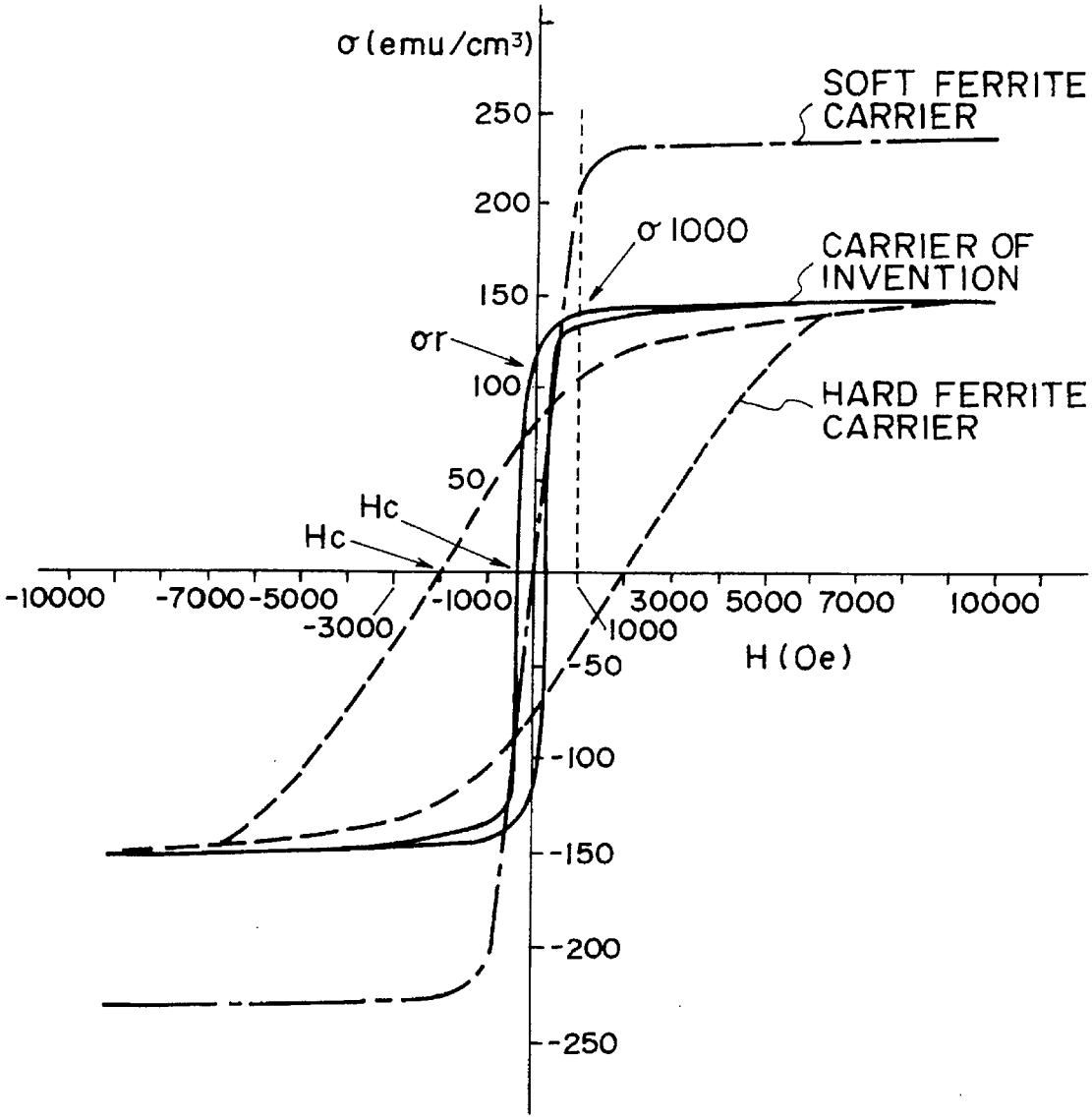
FIG. 2 is a graph showing hysteresis curves (magnetic characteristic curves) of the carrier of the present invention, a soft ferrite carrier and a hard ferrite carrier.

Incidentally, the magnetization values referred to herein and the magnetization curves shown in FIG. 1, 3 (upper curve), 4, 7, 8, 10 and 12 are based on values measured at specified values after magnetic saturation obtained by applying a magnetic field of 10 kilo-oersted, i.e., corresponding to an upper curve in a hysteresis loop as shown in FIG. 2, unless otherwise noted specifically.

The residual magnetization is required to be at least 25 emu/cm$^3$. If the residual magnetization is below 25 emu/cm$^3$ the carrier adhesion is liable to be caused, particularly in a developing system using a high contrast potential or an alternating electric field of a large amplitude in order to provide high-quality images. As a result, at the part of the carrier adhesion, a transfer failure is liable to be caused in a transfer step after the development, so that it is difficult to obtain high-quality toner images.

A coercive force of less than 300 oersted is required. At 300 oersted or higher, the carrier causes self-agglomeration so that the carrier shows a poor mixing characteristic with a toner and the carrier cannot move easily on the developing sleeve to show a poor conveyance characteristic, thus providing a poor coating characteristic of the developer and a difficulty in obtaining high-quality toner images.

FIG. 2 shows hysteresis curves of a typical magnetic carrier according to the present invention, a conventional magnetic carrier using a soft ferrite and a conventional magnetic carrier using a hard ferrite.

It is also important in the present invention that the carrier particles satisfy a relationship represented by the following formula:

$$|\sigma_{1000}-\sigma_{300}|/\sigma_{1000} \leqq 0.40$$

wherein $\sigma_{1000}$ and $\sigma_{300}$ denote magnetizations under magnetic field strengths of 1000 oersted and 300 oersted, respectively. The ratio, which may be referred to as a magnetization stability (factor) herein, may preferably be at most 0.30.

Figure 4:
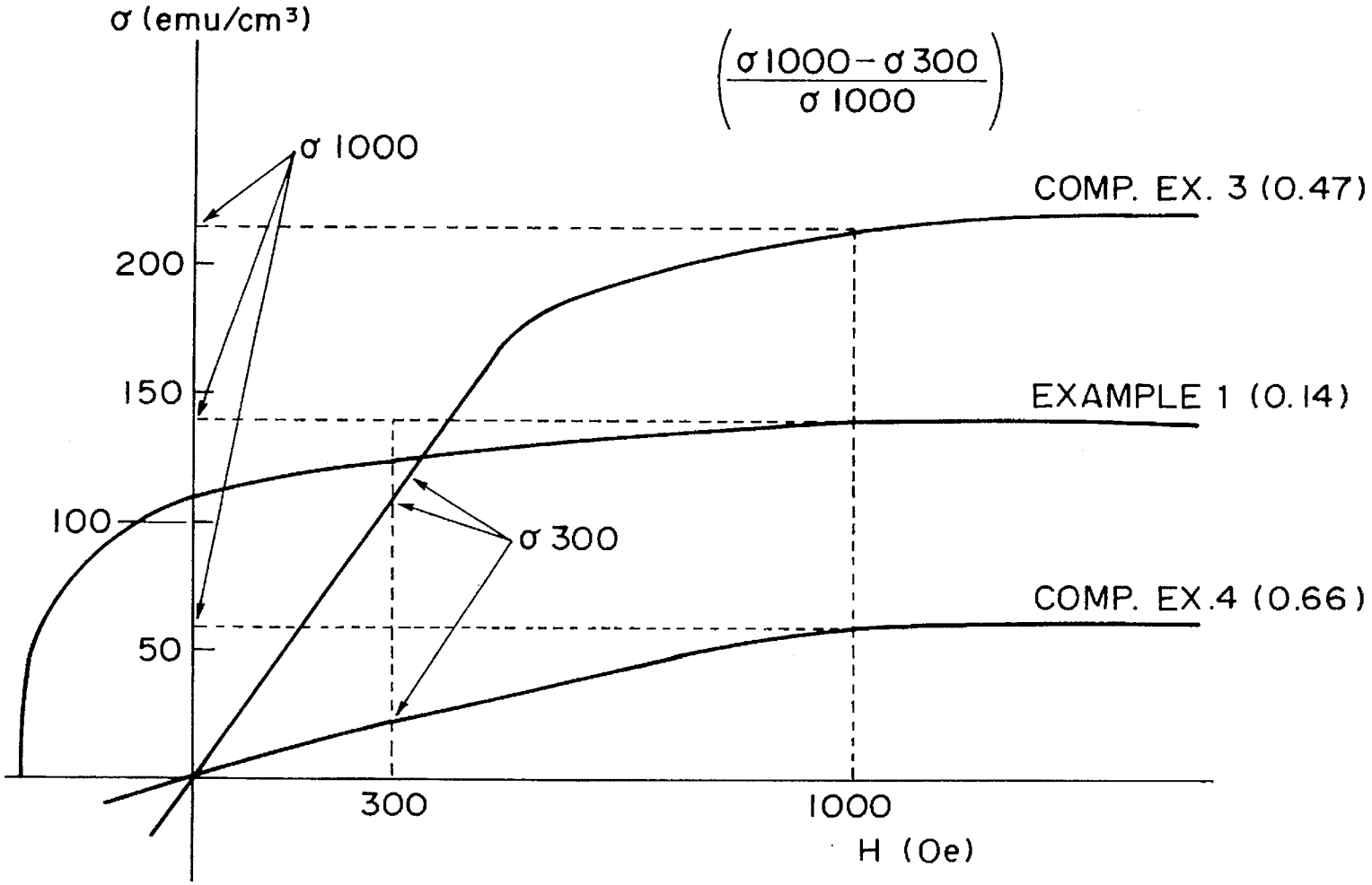
FIG. 4 is a graph showing magnetization curves along with values of $(\sigma_{1000}-\sigma_{300})/\sigma_{1000}$ as parameters.

An explanation is given with reference to FIG. 4 which shows magnetization curves after magnetic saturation of carriers of Example 1 and Comparative Examples 3 and 4 appearing hereinafter. If the value (magnetization stability) exceeds 0.40, it becomes difficult to prevent the carrier adhesion while improving the image quality. More specifically, if $\sigma_{1000}$ is set to a satisfactory value for improving the image quality, the carrier adhesion is liable to occur. If $\sigma_{300}$ is set to a satisfactory value, the carrier adhesion can be prevented but $\sigma_{1000}$ becomes too large to obtain high-quality images.

In the present invention, the magnetic values may be measured, e.g., by using a DC magnetization B-H characterization auto-recording apparatus (e.g., "BHH-50" available from Riken Denshi K.K.). A magnetic pole in an ordinary developing apparatus provides a magnetic field on the order of 1 kilo-oersted, and the magnetic values of carriers described herein have been obtained from hysteresis curves obtain by producing magnetic fields of +10 kilo-oersted. More specifically, the magnetic properties of a carrier may be measured by loosely packing a sample carrier in a cylindrical plastic container and then strongly packing the sample under a magnetic field of 10 kilo-oersted to form a fixed sample for measurement of the magnetic properties. The magnetic properties measured in this state are described herein as representative values. A sample holder used had a volume of 0.332 $cm^3$ which may be used for calculation of a magnetization per unit volume.

The carrier particles according to the present invention may preferably have an average particle size of 5–100 μm, more preferably 20–80 μm, further preferably 20–60 μm. Below 5 μm, the carrier adhesion onto a photosensitive member is liable to occur. Above 100 μm, the magnetic brush at a developing pole becomes coarse so that it becomes difficult to obtain high-quality toner images. The particle sizes of carriers described herein are based on values measured by sampling 300 particles at random through an optical microscope and measuring the average horizontal FERE diameter as a carrier particle size by an image analyzer (e.g., "Luzex 3" available from Nireco K.K.).

The carrier according to the present invention may preferably have a bulk density of at most 3.0 $g/cm^3$ as measured by JIS Z 2504. Above 3.0 $g/cm^3$ the force of magnetically retaining the carrier on the developing sleeve can be exceeded by a centrifugal force exerted to the carrier particles due to rotation of the developing sleeve, so that carrier scattering is liable to be caused.

The carrier according to the present invention may preferably have a sphericity of at most 2. If the sphericity exceeds 2, the resultant developer is caused to have a poor fluidity and provides a magnetic brush of an inferior shape, so that it becomes difficult to obtain high-quality toner images. The sphericity of a carrier may be measured, e.g., by sampling 300 carrier particles at random through a field-emission scanning electron microscope (e.g., "S-800", available from Hitachi K.K.) and measuring an average of the sphericity defined by the following equation by using an image analyzer (e.g., "Luzex 3", available from Nireco K.K.):

$$\text{Sphericity(SF1)}=[(\text{MX LNG})^2/\text{AREA}]\times\pi/4,$$

wherein MX LNG denotes the maximum diameter of a carrier particle, and AREA denotes the projection area of the carrier particle. As the sphericity is closer to 1, the shape is closer to a sphere.

Figure 5:
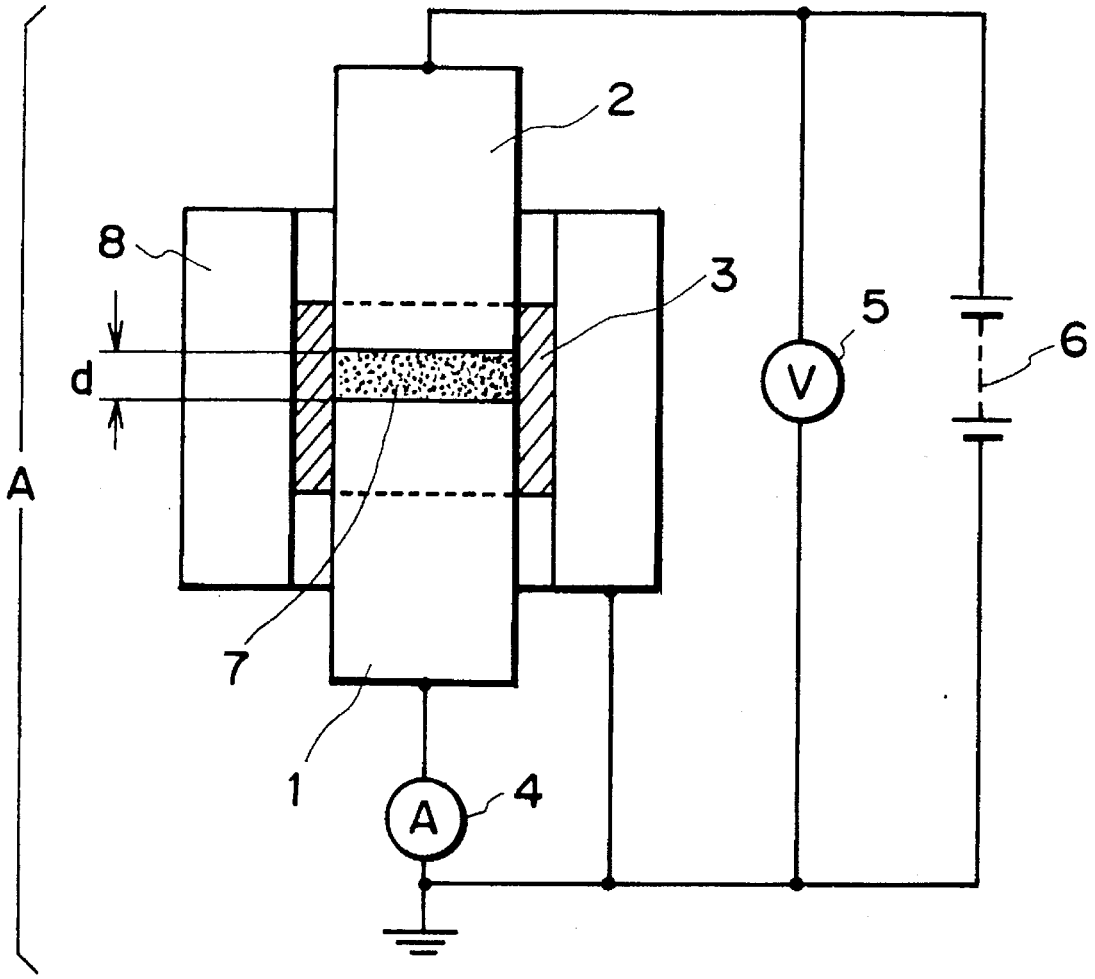
FIG. 5 is a schematic view showing a measurement apparatus of electrical resistivity.

The carrier according to the present invention may preferably have a resistivity of $10^8$–$10^{13}$ Ω.cm, when used in a developing method applying a bias voltage, the carrier is liable to cause a leak of current from the developing sleeve to the photosensitive member surface, thus causing a difficulty in providing good toner images. Above $10^{13}$Ω.cm, the carrier is liable to cause a charge-up phenomenon under a low humidity condition, thus causing toner image defects, such as a low image density, transfer failure, fog, etc. The resistivity may be measured by using an apparatus (cell) A as shown in FIG. 5 equipped with a lower electrode 1, an upper electrode 2, an insulator 3, an ammeter 4, a voltmeter 5, a constant-voltage regulator 6 and a guide ring 8. For measurement, the cell A is charged with a sample carrier 7, in contact with which the electrodes 1 and 2 are disposed to apply a voltage therebetween, whereby a current flowing at that time is measured to calculate a resistivity. In the above measurement, an attention should be paid so as not to cause a change in packing density of a powdery carrier sample leading to a fluctuation in measured resistivity. The resistivity values described herein are based on measurement under the conditions of the contact area between the carrier 7 and the electrode 1 or 2=about 2.3 $cm^2$ the carrier thickness=about 1 mm, the weight of the upper electrode 2=275 g, and the applied voltage=100 volts.

In order to accomplish the above-mentioned properties of the carrier according to the present invention, it is preferred to use a magnetic material comprising a metal oxide or an iron-based alloy, such as carbon steel, chromium steel, cobalt-chromium steel, vicalloy and alnico Al—Ni—Co, etc. More preferably, the carrier may comprise magnetic ferrite particles containing at least one element selected from the group consisting of elements of groups IA, IIA, IIIA, IVA, VA, VIA, IB, IIB, IVB, VB, VIB, VIIB and VIII according to the periodic table, and less than 1 wt. %, if any, of another element.

More specifically, the carrier particles may preferably comprise a ferrite containing: Fe and O as essential elements; at least one element selected from the group consisting of Li, Be, B, C, N, Na, Mg, Al, Si, P, S, K, Ca, Ti, V, Cr, Mn, Co, Ni, Cu, Zn, Ga, Ge, As, Se, Rb, Sr, Zr, Nb, Mo, Tc, Ru, Rh, Pd, Ag, Cd, In, Sn, Sb, Te, Cs, Ba, Hf, Ta, W, Re, Os, Ir, Pt, Au, Tl, Pb, and Bi, and less than 1 wt. %, if any, of, another element. If another element different from those specifically mentioned above is contained, it becomes difficult to obtain a carrier showing the above-described desired magnetic properties according to the present invention and the resistivity is liable to be lowered.

The carrier according to the present invention may preferably comprise a single phase of a spinel structure, a single phase of a magnetoplumbite structure, a composite phase including at least a spinel structure and a magnetoplumbite structure, or a composite phase of a spinel structure and a magnetoplumbite structure. It is preferred to use a composite phase including a spinel structure phase and a magnetoplumbite structure phase in a molar ratio of 1:1 to 10:1. It is preferred that the spinel structure phase and the magnetoplumbite phase have not substantially reacted with each other.

By taking a crystal form as described above, it is possible to suitably produce a carrier showing the required magnetic properties of a magnetization at 1000 oersted ($\sigma_{1000}$) of 30–150 $emu/cm^3$, a residual magnetization ($\sigma_r$) of 25 $emu/cm^3$ and a coercive force of below 300 oersted after magnetic saturation.

The crystal structure of a carrier may be measured by X-ray diffraction analysis and/or fluorescent X-ray analysis.

The carrier according to the present invention may be prepared through processes, such as sintering and atomizing. The carrier having the required properties of the present invention may suitably be produced by two or more species of crystal fine powder to mixture-sintering as desired.

The carrier according to the present invention may easily accomplish the characteristic magnetic properties of the present invention by using ferrite particles of the above-described composition after magnetization thereof, e.g., by placing the ferrite particles in a magnetic field of, e.g., +10 kilo-oersted given by a DC electromagnet.

The carrier particles according to the present invention may be coated with a resin, as desired, for the purpose of resistivity control, improvement in durability, etc. The coating resin may be a known appropriate resin. Examples thereof may include acrylic resin, fluorine-containing resin, silicone resin, epoxy resin and styrene resin. Thus, the term "carrier" used herein covers both a coated carrier surface-coated with, e.g., a resin, and an uncoated carrier.

According to a preferred embodiment, the carrier of the present invention may be embodied as a magnetic material-dispersion type resinous carrier which comprises resinous carrier particles containing magnetic fine particles dispersed within a binder, the carrier particles having a particle size of 5–100 μm and a bulk density of at most 3.0 $g/cm^3$, containing the magnetic fine particles at a content of 30–99 wt. % of the carrier, and showing magnetic properties including a magnetization of 30–150 emu/cm$^3$ under a magnetic field strength of 1000 oersted, a magnetization (residual magnetization or) of at least 25 emu/cm$^3$ under a magnetic field strength of zero oersted, a coercive force of less than 300 oersted, and a relationship of:

$$|\sigma_{1000}-\sigma_{300}|/\sigma_{1000}\leq 0.40$$

wherein $\sigma_{1000}$ and $\sigma_{300}$ denote magnetizations under magnetic field strengths of 1000 oersted and 300 oersted, respectively.

The magnetic fine particles dispersed within a binder resin may comprise a magnetic material. selected from the class of magnetic materials described with reference to the previous embodiment.

It is also possible to disperse two or more species of magnetic fine particles in mixture within a binder resin.

The magnetic fine particles may preferably have a primary particle size of at most 2.0 μm. Above 2.0 μm, the magnetic fine particles can show poor dispersibility within the binder resin.

In the magnetic material dispersion-type resinous carrier, the magnetic fine particles may be contained in a proportion of at least 30 wt. %, preferably be at least 50 wt. %. Below 30 wt. %, the carrier adhesion onto a photosensitive member is liable to occur, and the resistivity control of the carrier also becomes difficult. In excess of 99 wt. % of the magnetic fine particles content, the adhesion between the particles with the binder resin becomes inferior.

The carrier according to the present invention may easily accomplish the characteristic magnetic properties of the present invention by using such magnetic material dispersion-type resinous carrier particles after magnetization thereof, e.g., by placing the particles in a magnetic field of e.g., +10 kilo-oersted given by a DC electromagnet.

The binder resin used together with the magnetic material for constituting the dispersion-type carrier particles (which can also be used as core particles of a coated carrier) in the present invention may for example comprise the following materials.

Homopolymers or copolymers of vinyl monomers shown below: styrene; styrene derivatives, such as o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; ethylenically unsaturated monoolefins, such as ethylene, propylene, butylene and isoprene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate methacrylic acid; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, and phenyl methacrylate; acrylic acid; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; and acrolein. These may be used singly or in mixture of two or more species.

In addition to the vinyl-type resins (i.e., homopolymers or copolymers of vinyl monomers as described above), it is also possible to use non-vinyl or condensation-type resins, such as polyester resins, epoxy resins, phenolic resins, urea resins, polyurethane resins, polyimide resins, cellulosic resins and polyether resins, or mixtures of these resins with the above-mentioned vinyl-type resins.

In order to provide the resinous carrier particles with a sphericity of at most 2, the carrier particles may be prepared by spray drying of a slurry formed by mixing and dispersion of the magnetic fine particles and the binder to form dried particles, or by hot-kneading followed by pulverization of the mixture to form particles and then causing the particles to impinge at a high speed onto a plate for surface melting of the particles by the impinging energy to improve the sphericity.

The dispersion-type resinous carrier may be prepared through a process wherein the binder resin and the magnetic fine particles are blended in a prescribed quantity ratio and kneaded at an appropriate temperature by a hot-melt kneading device, such as a three-roll kneader or an extruder, followed by cooling, pulverization and classification; or a process wherein a solution of the binder resin in an appropriate solvent and the magnetic fine particles are mixed to form a slurry and spray-drying the slurry to form particles, followed by drying. The particles obtained in the above-described manner can be subjected to a post-treatment for improving the shericity. As an alternative process, it is also possible to adopt a suspension polymerization process wherein the magnetic fine particles are mixed with a monomer liquid of the binder resin along with a polymerization initiator, a dispersion stabilizer, etc., and the mixture is dispersed within an aqueous medium, followed by suspension polymerization. According to this process, the carrier particles having a sphericity of at most 2.0 may be produced without further sphericity-improving post treatment.

The magnetic material dispersion-type resinous carrier particles can further be coated with a resin, as desired, for the purpose of, e.g., controlling the resistivity and improving the durability. The coating resin may be a known appropriate resin. Examples thereof may include acrylic resin, fluorine-containing resin, silicone resin, epoxy resin and styrene resin.

In this case, as the particles to be coated already comprise a resin, it is preferred to use a rapid coating method wherein individual carrier particles do not adhere to each other. More specifically, it is preferred to appropriately select a solvent for the coating resin, adequately control the temperature and time for the coating, and keep the carrier particles to be coated in an always fluidized state, so as to proceed with the coating and drying simultaneously.

According to another preferred embodiment, the carrier of the present invention may be embodied as a magnetic material-dispersion type resinous carrier which comprises resinous carrier particles containing magnetic fine particles dispersed within a binder; the carrier particles having a particle size of 5–100 μm, a bulk density of at most 3.0 g/cm$^3$ and magnetic fine particle content of 30–99 wt. %; the magnetic fine particles dispersed within the carrier being in the form a plate or needle having a longer axis/shorter axis ratio exceeding 1, showing a there dimensionally uniaxial shape anisotropy and including at least 30 wt. % thereof, preferably at least 50 wt. % thereof, in an oriented state; the carrier particles having magnetic properties including: a magnetization of 30–150 emu/cm$^3$ under a magnetic field strength of 1000 oersted, a magnetization (residual magnetization $\sigma_r$) of at least 25 emu/cm$^3$ under a magnetic field strength of zero oersted, a coercive force of less than 300 oersted, and a relationship of:

$$|\sigma_{1000}-\sigma_{300}|/\sigma_{1000} \leqq 0.40$$

wherein $\sigma_{1000}$ and $\sigma_{300}$ denote magnetizations under magnetic field strengths of 1000 oersted and 3000 oersted, respectively.

Figure 8:
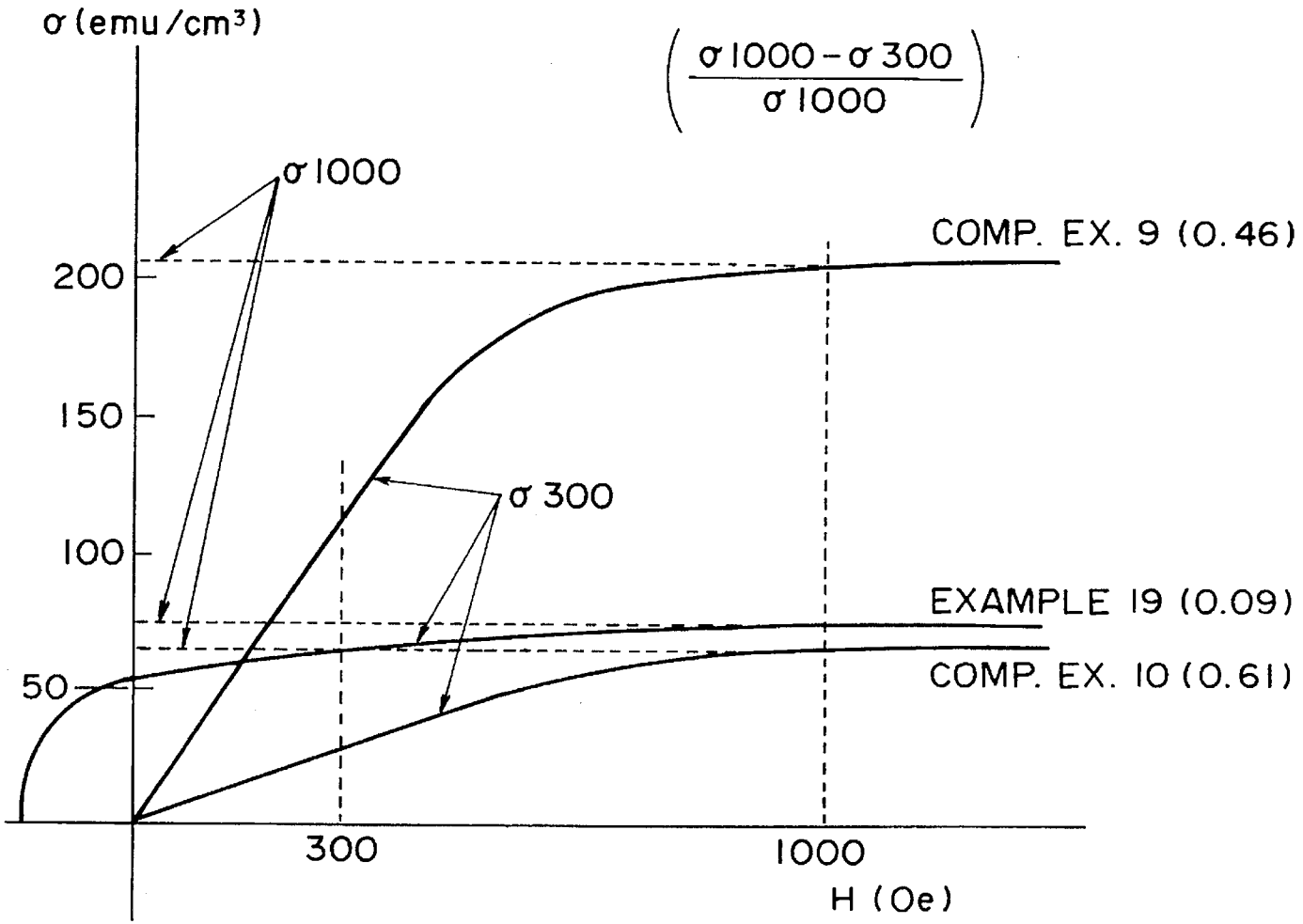
FIG. 8 is a graph showing magnetization curves of carriers, used in Example 19 and Comparative Examples 9 and 10, along with values of $(\sigma_{1000}-\sigma_{300})/\sigma_{1000}$ as parameters.
Figure 9:
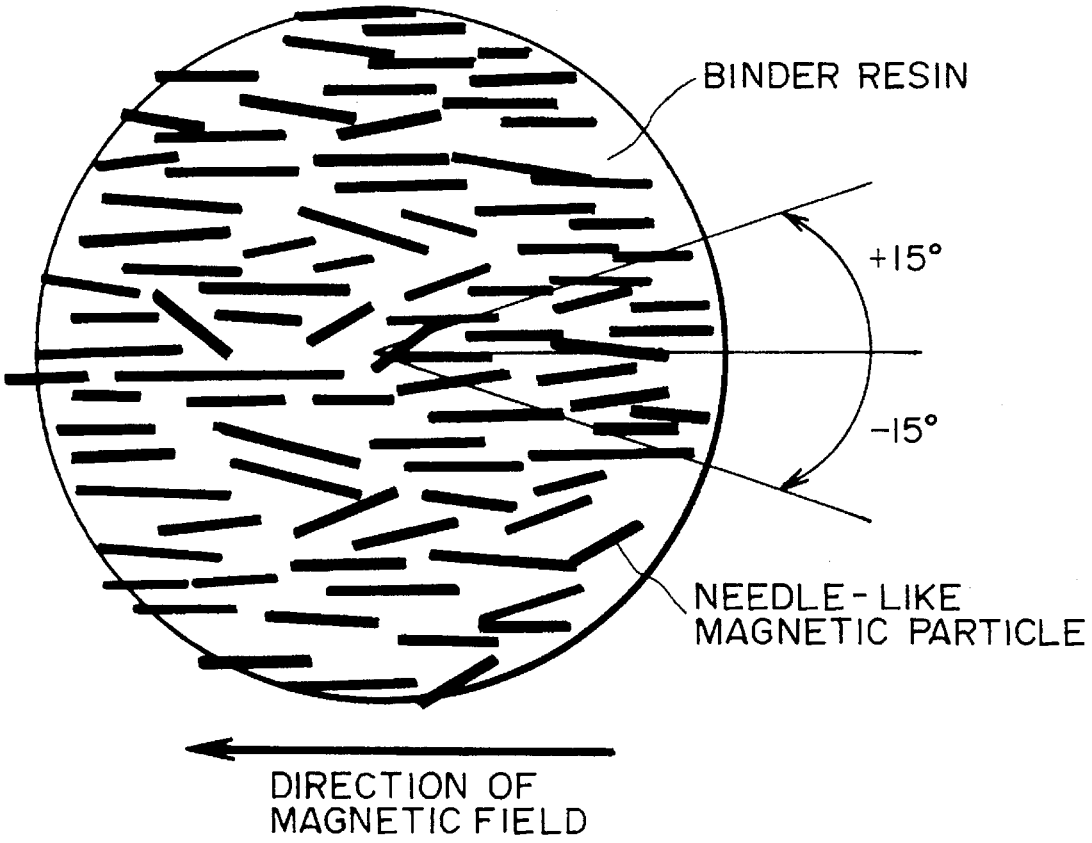
FIG. 9 is a schematic view of an orientation state of the carrier according to the present invention, wherein a magnetic material is denoted, by needle-like particles oriented parallel to the direction of an applied magnetic field (shown by an arrow) and angles of +15 degrees and −15 degrees for measuring an orientation degree are also shown.

If at least 30 wt. % of the magnetic particles dispersed within the carrier are oriented as shown in FIG. 9, the residual magnetization of the carrier can be further strengthened. By using the resinous carrier thus obtained showing $\sigma_{1000}$ of 30–150 emu/cm$^3$, which is lower than that of a conventional carrier, but showing a strengthened magnetization at 0–300 emu/cm$^3$ as represented by a magnetization curve shown in FIG. 8, it is possible to accomplish the higher-quality image formation and the prevention of carrier adhesion simultaneously.

The degree of orientation of the magnetic fine particles within the carrier may be defined by the proportion of oriented magnetic fine particles having a shape anisotropy used in the present invention and measured by statistically treating the orientation of magnetic fine particles within a carrier section observed through a field-emission scanning electron microscope (FE-SEM) (e.g., "S-800", available for Hitachi K.K.). More specifically, microscopic pictures showing 10 carrier sections sampled at random are taken, and 100 magnetic fine particles showing a shape anisotropy are taken at random from the pictures to calculate the proportion of the magnetic fine particles oriented within a range of ±15 degrees from an assumed direction of the magnetic field. Carrier section samples may be prepared by dispersing carrier particles within an epoxy resin, followed by fixation by solidification, and slicing the carrier-embedded resin samples by a microtome (e.g., "FC4E", available from REICHER-JUNG). FIG. 9 shows an example of such a microscopically enlarged carrier section sample using a needle-like magnetic material.

The magnetic fine particles to be dispersed within the carrier may comprise a particulate metal oxide magnetic material having a shape anisotropy and an average primary particle size of at most 1 μm, examples of which may include: hexagonal plate-like crystal of, e.g., Be-based ferrite, Sr-based ferrite, and Pb-based ferrite; and needle-like magnetic material of $\gamma$-$Fe_2O_3$ type and Co-based ferrite. These magnetic materials having a shape anisotropy may be used alone or in particle mixture of two or more species thereof, or in particle mixture with a soft magnetic material, such as soft ferrite. These magnetic materials may be oriented by mechanically, e.g., as by injection molding, or magnetically.

By using such a composition and an oriented form, it is possible to suitably produce a carrier showing the required magnetic properties of a magnetization at 1000 oersted ($\sigma_{1000}$) of 30–150 emu/cm$^3$, a residual magnetization ($\sigma_r$) of 25 emu/cm$^3$ and a coercive force of below 300 oersted after magnetic saturation.

According to another preferred embodiment, the carrier of the present invention may be embodied as an electrophotographic carrier which comprises carrier particles comprising crystalline plate-like or needle-like magnetic particles; the crystalline magnetic particles having a longer axis/shorter axis ratio exceeding 1, showing a there-dimensionally uniaxial shape anisotropy and including at least 30 wt. % thereof preferably at least 50 wt. % thereof, in an oriented state: the carrier particles having magnetic properties including: a magnetization of 30–150 emu/cm$^3$ under a magnetic field strength of 1000 oersted, a magnetization (residual magnetization $\sigma_r$) of at least 25 emu/cm$^3$ under a magnetic field strength of zero oersted, a coercive force of less than 300 oersted, and a relationship of:

$$|\sigma_{1000}-\sigma_{300}|/\sigma_{1000} \leqq 0.40$$

wherein $\sigma_{1000}$ and $\sigma_{300}$ denote magnetizations under magnetic field strengths of 1000 oersted and 3000 oersted, respectively.

Figure 10:
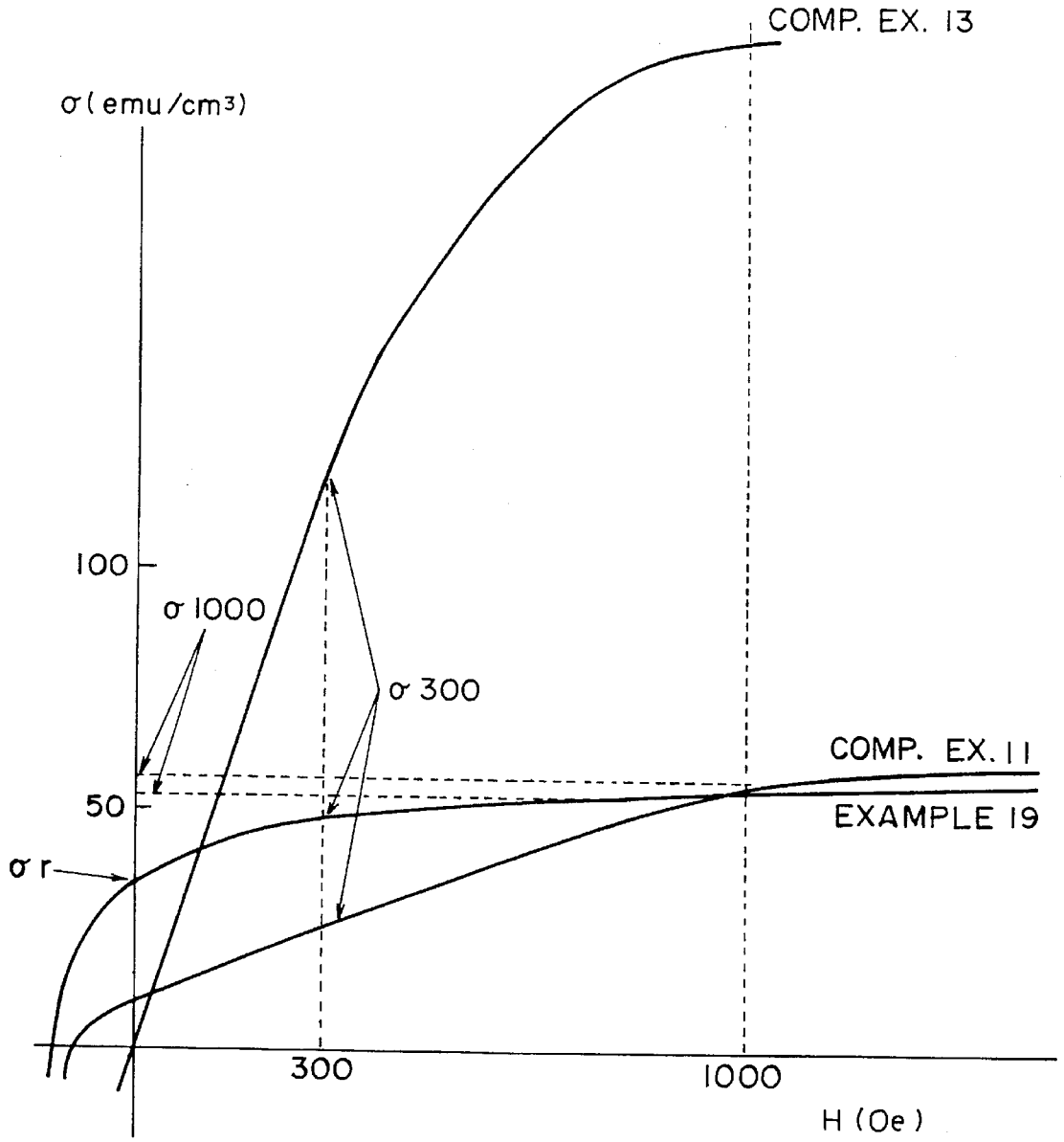
FIG. 10 is a graph showing magnetization curves of carries, used in Example 19 and Comparative Examples 11 and 13.
Figure 11:
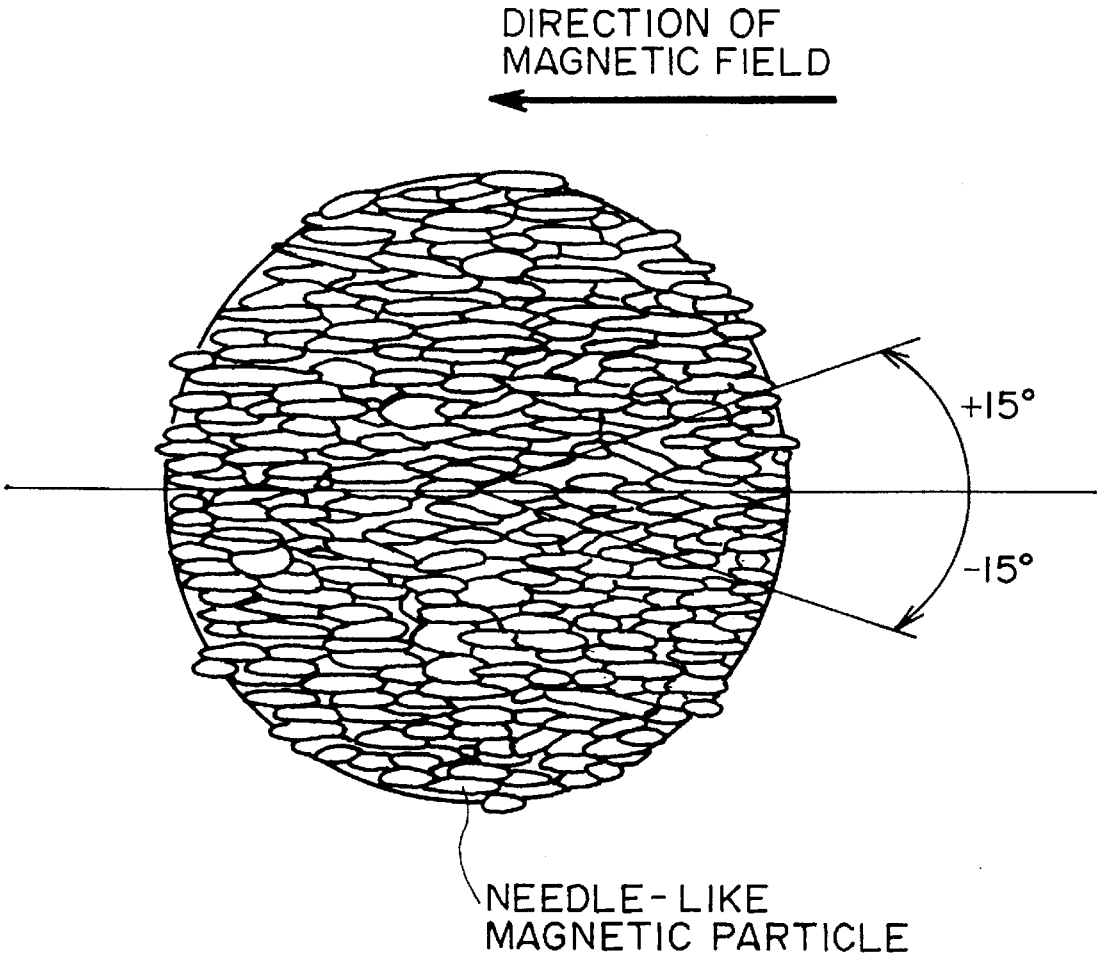
FIG. 11 is a schematic view of an orientation state of the carrier according to the present invention, wherein a magnetic material is denoted, by needle-like particles oriented parallel to the direction of an applied magnetic field (shown by an arrow) and angles of +15 degrees and −15 degrees for measuring an orientation degree are also shown.
Figure 12:
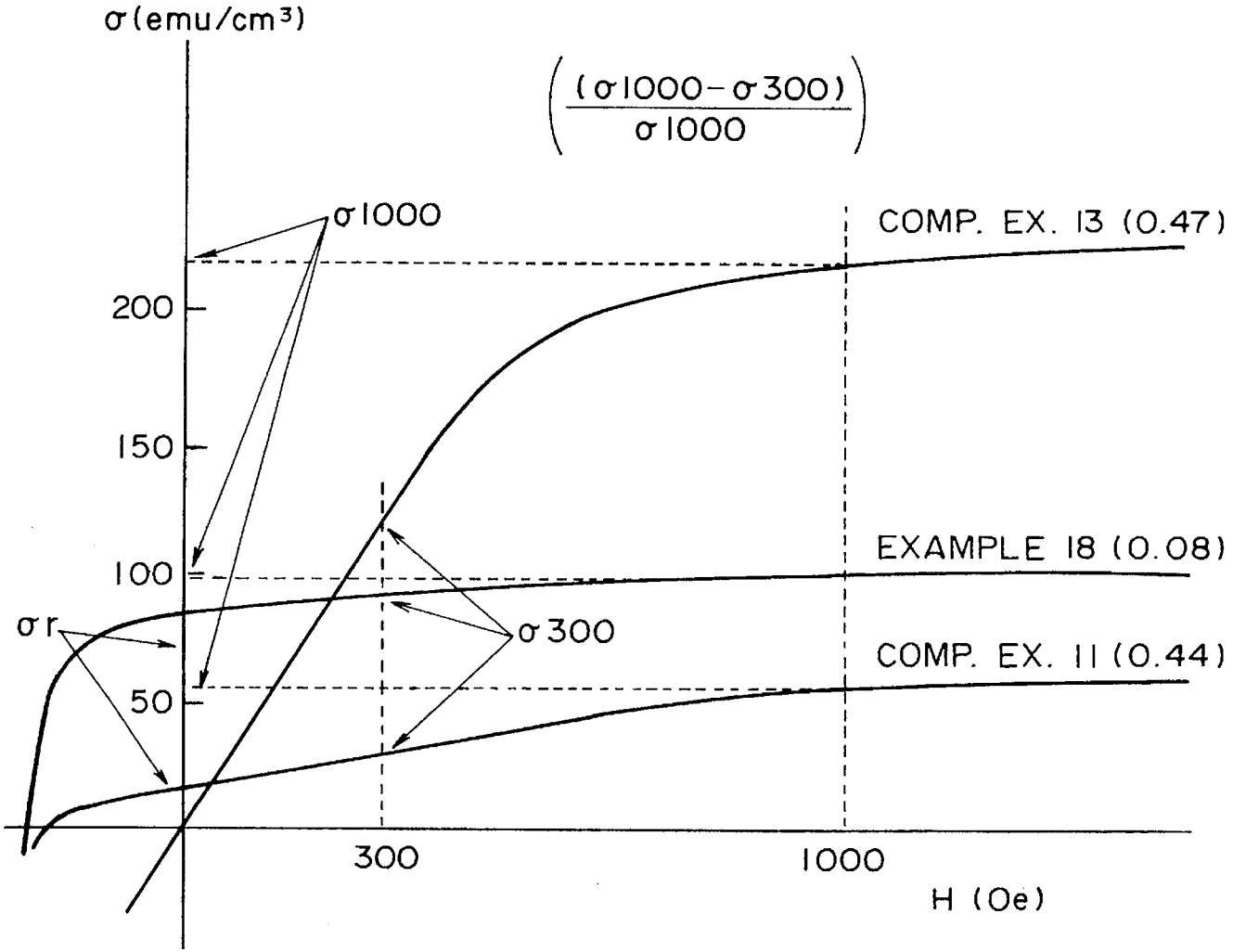
FIG. 12 is a graph showing magnetization curves of carriers, used in Example 18 and Comparative Examples 11 and 13, along with values of $(\sigma_{1000}-\sigma_{300})/\sigma_{1000}$ as parameters.

If at least 30 wt. %, preferably at least 50 wt. %, of the magnetic particles dispersed within the carrier are oriented as shown in FIG. 11, the residual magnetization of the carrier can be further strengthened. By using the carrier thus obtained showing $\sigma_{1000}$ of 30–150 emu/cm$^3$, which is lower than that of a conventional carrier, but showing a strengthened magnetization at 0–300 emu/cm$^3$ as represented by a magnetization curve shown in FIG. 10, it is possible to accomplish the higher-quality image formation and the prevention of carrier adhesion simultaneously.

The degree of orientation of the crystalline magnetic particles constituting the carrier may be defined by the proportion of oriented magnetic fine particles having a shape anisotropy used in the present invention and measured by statistically treating the orientation of crystalline magnetic particles at the surface of carrier particle observed through a field-emission scanning electron microscope (FE-SEM) (e.g., "S-800", available fro Hitachi K.K.). More specifically, microscopic pictures showing the surfaces of 10 carrier particles sampled at random are taken, and 100 crystalline magnetic particles showing a shape anisotropy are taken at random from the pictures to calculate the proportion of the crystalline magnetic particles oriented within a range of ±15 degrees from an assumed direction of the magnetic field. FIG. 11 schematically illustrates an example of such an orientation state of crystalline magnetic particles within a carrier particle using a needle-like magnetic material.

Such carrier particles showing the required magnetic properties may be prepared, e.g., through a process wherein magnetic fine particles of 1 μm or smaller obtained by the wet process or the dry process are size-enlarged while being magnetically oriented in a magnetic field and then sintered.

The carrier particles thus prepared may be coated with a resin, as desired, for the purpose of resistivity control, improvement in durability, etc. The coating resin may be a known appropriate resin. Examples thereof may include acrylic resin, fluorine-containing resin, silicon resin, epoxy resin and styrene resin. Thus, the term "carrier" used herein covers both a coated carrier surface-coated with, e.g., a resin, and an uncoated carrier.

The toner to be used in combination with the carrier according to the present invention may have a weight-average particle size of 1–20 μm, preferably 4–10 μm, as measured, e.g., by a Coulter counter.

In order to obtain a high-quality image, the toner may preferably have as low an agglomeration degree as possible, particularly 30% or below. The agglomeration degree may be measured in the following manner.

Three sieves of 60 mesh, 100 mesh and 200 mesh are stacked in this order from the above and set on a powder tester (available from Hosokawa Micron K.K.), and a sample toner weighed in 5 g is placed on the sieves. Then, the sieves are vibrated for 15 sec. while applying a voltage of 17 volts, and the weights of portions of the toner sample remaining on the respective sieves are measured to calculate the agglomeration degree based on the following equation:

agglomeration degree = [((sample weight on 60 mesh-sieve) + (sample weight on 100 mesh-sieve) × 3/5 + (sample weight on 200 mesh-sieve) × 1/5)/ (sample weight (about 5 g) placed on the sieves)] × 100

In order to lower the agglomeration degree, it is preferred to add a fluidity improver, such as silica, titanium oxide or alumina, to be internally incorporated within or externally mixed with the toner.

The carrier and the toner may preferably be mixed in such a ratio as to provide a two component-type developer having a toner concentration of 0.5–20 wt. %, particularly 1–10 wt. %.

Figure 6:
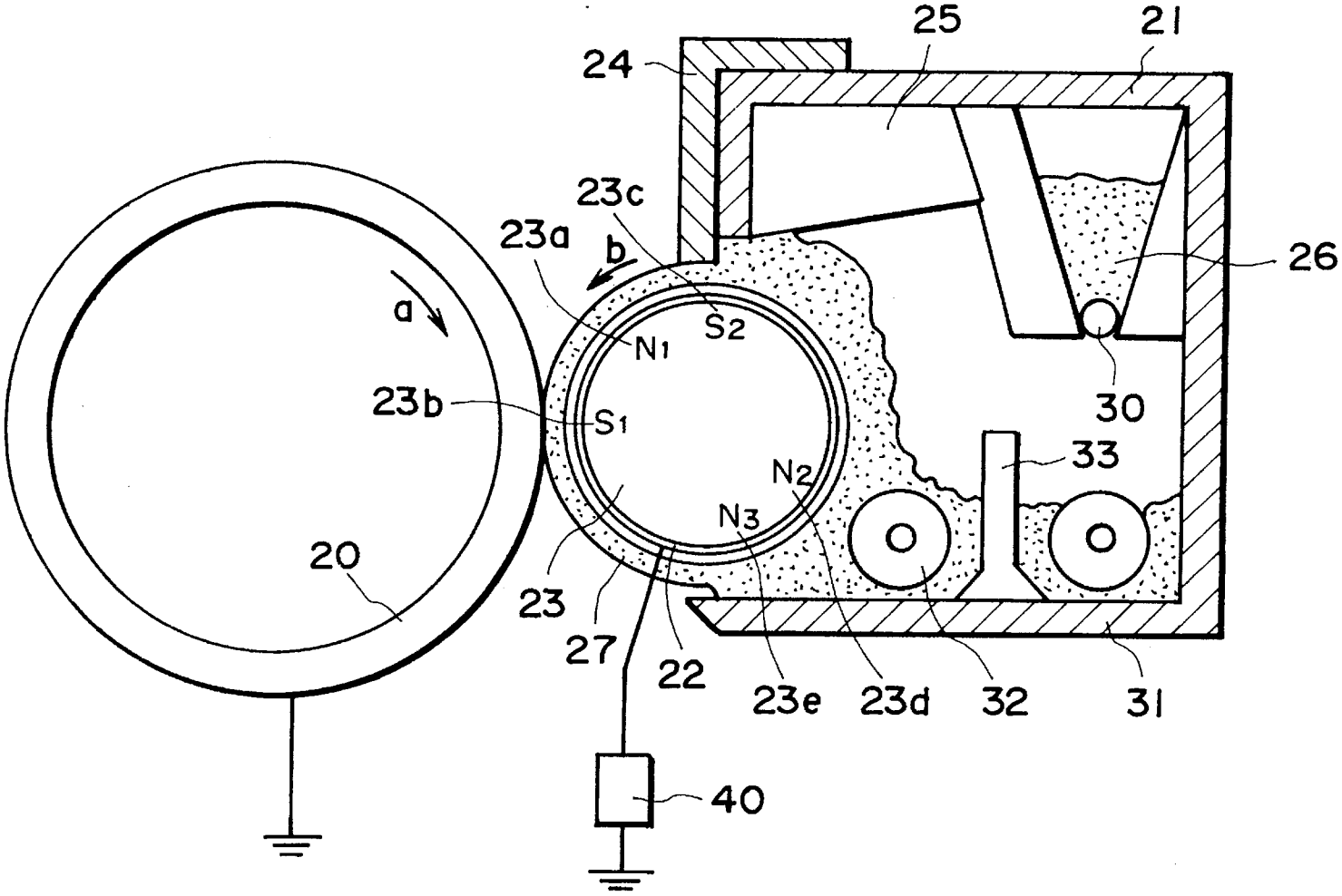
FIG. 6 is a schematic view of a developing device and a photosensitive drum.
Figure 7:
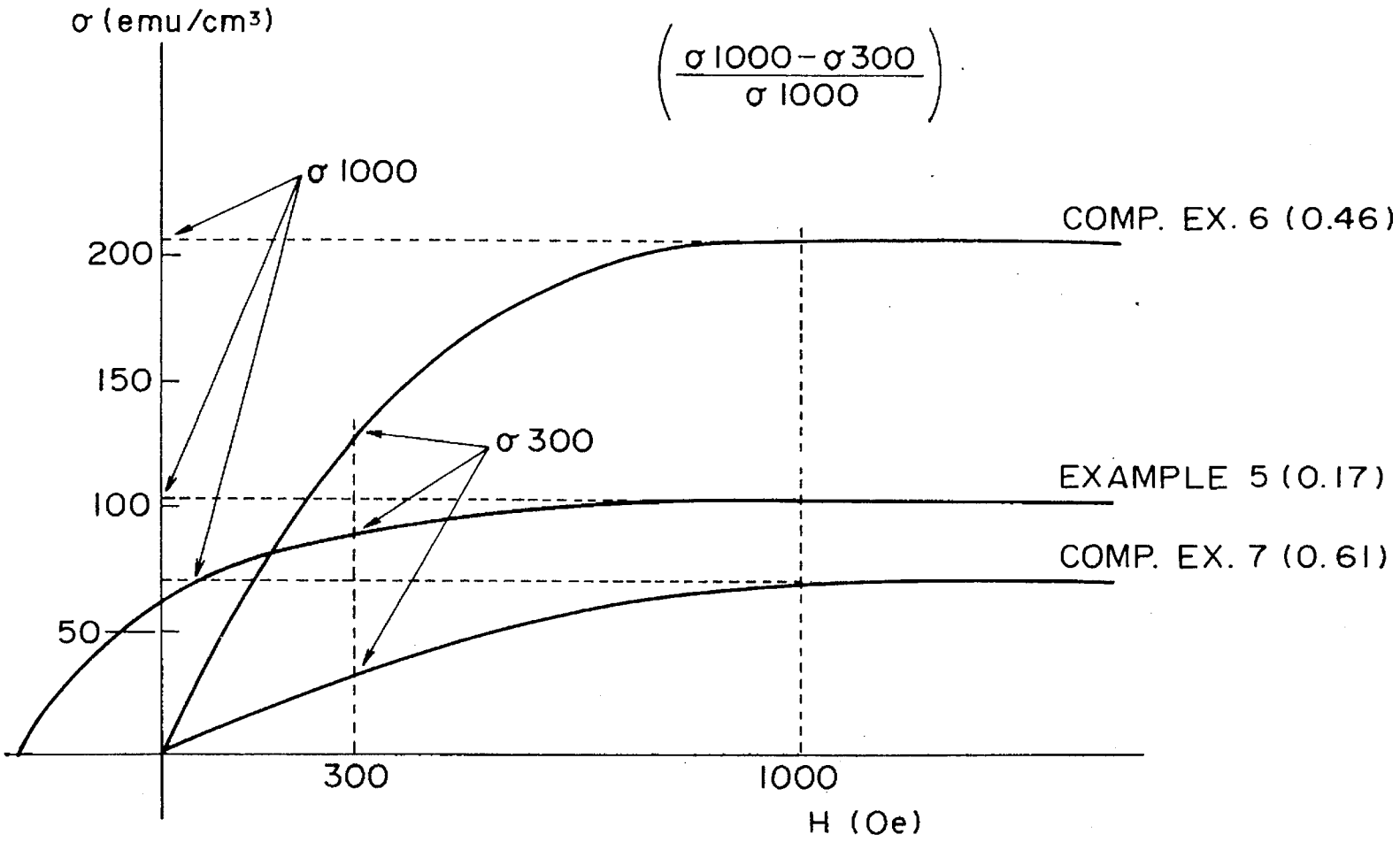
FIG. 7 is a graph showing magnetization curves of carriers, used in Example 5 and Comparative Examples 6 and 7, along with values of $(\sigma_{1000}-\sigma_{300})/\sigma_{1000}$ as parameters.

Next, the image forming method according to the present invention will be described with reference to an embodiment using a developing apparatus shown in FIG. 6.

A latent image-bearing member 20 may be an insulating drum for electrostatic recording, or a photosensitive drum (as shown) or a photosensitive belt surfaced with a layer of an insulating photoconductor material, such as α-Se, CdS, $ZnO_2$, OPC (organic photoconductor) or a-Si. The latent image-bearing member 20 is rotated in the direction of an arrow a by a driving mechanism (not shown). In proximity with or in contact with the latent image-bearing member, a developing sleeve 22 (as a developer-carrying member) is disposed. The developing sleeve 22 is composed of a non-magnetic material, such as aluminum or SUS 316. About a right half of the developing sleeve 22 is projected into or enclosed within a lower-left part of a developer container 21 through a horizontally extending opening provided along the longitudinal extension of the container 21, and about a left-half of the developing sleeve 22 is exposed to outside the container. The developing sleeve 22 is rotatably held about an axis extending perpendicularly to the drawing and driven in rotation in the direction of an arrow b.

Within the developing sleeve 20 (developer-carrying member) is inserted a fixed permanent magnet 23 which is held in a position as shown as a fixed magnetic field generating means. The magnet 23 is fixedly held at a position as shown even when the developing sleeve 22 is driven in rotation. The magnet 23 has 5 magnetic poles including N-poles 23*a*, 23*d*, 23*e* and S-poles 23*b* and 23*c*. The magnet 23 can comprise an electro-magnet instead of a permanent magnet.

A non-magnetic blade 24 as a developer-regulating member, which has been formed by bending a member of, e.g., SUS 316 so as to have an L-section as shown, is disposed at an upper periphery of the opening of the developer container 21 in which the developing sleeve 22 is installed so that the base part of the blade 24 is fixed to the wall of the container 21.

The magnetic carrier-regulating member 25 is disposed with its upper face directed toward the non-magnetic blade 24 and with its lower face functioning as a developer guiding surface. A regulating part is constituted by the non-magnetic blade 24 and the magnetic carrier-regulating member 25.

As developer layer 27 is formed of a developer including the carrier of the present invention and a non-magnetic toner 27 supplied by a toner-replenishing roller 30 driven according to an output from a toner concentration-detecting sensor (not shown). The sensor may be constituted by a developer volume-detecting scheme, a piezoelectric device, induction change-detecting device, an antenna scheme utilizing an alternating bias, or an optical density-detecting scheme. The non-magnetic toner 26 is replenished in a controlled amount depending on the rotation and stopping of the roller 30. A fresh developer replenished with the toner 26 is mixed and stirred while being conveyed by a developer-conveying roller 31. As a result, during the conveyance, the replenished toner is triboelectrically charged. A partition 31 is provided with cuts at both longitudinal ends thereof, through which the fresh developer conveyed by the roller 31 is transferred to a screw 32.

An S-magnetic pole 23 is a conveying pole and functions to recover the unused developer into the container and convey the developer to the regulating part.

Near the S pole 23*d*, the fresh developer and the recovered developer are mixed with each other by the screw 32 disposed near the developing sleeve.

The lower end of the non-magnetic blade 24 and the surface of the developing sleeve 24 may be spaced from each other with a gap of 100–900 μm, preferably 150–800 μm. If the gap is smaller than 100 μm, the carrier particles are liable to clog the gap, thus being liable to cause an irregularity in the resultant developer layer and failing to apply the developer in a manner as to provide a good developing performance, thereby only resulting in developed images which are thin in image density and are accompanied with much irregularity. On the other hand, if the gap exceeds 900 μm, the amount of the developer applied onto the developing sleeve 22 is increased, thus failing in regulation to a prescribed developer layer thickness, resulting in an increased carrier adhesion onto the latent image-bearing member and weakening the regulation of the developer by the developer-regulating member 25 to cause an insufficient triboelectricity leading to a tendency of fog.

It is preferred that the developer layer thickness on the developing sleeve 22 is made equal to or slightly larger than a gap of preferably 50–800 μm, more preferably 100–700 μm, between the developing sleeve 22 and the latent image-bearing member 20 at their opposing position, while applying an alternating electric field across the gap.

By applying a developing bias comprising an alternating electric field optionally superposed with a DC electric field between the developing sleeve 22 and the latent image-bearing member 20, it is possible to facilitate the toner movement from the developing sleeve 22 to the latent image-bearing member 20, thereby forming images with further better qualities.

The alternating electric field may preferably comprise an AC electric field of 1000–10000 Vpp, more preferably 2000–8000 Vpp, optionally superposed with a DC electric field of at most 1000 V.

Hereinbelow, the present invention will be described based on Examples which should not be however understood to restrict the scope of the present invention. In the following description, "%" and "part(s)" used to describe a formulation mean those by weight unless otherwised noted specifically.

EXAMPLE 1

$Fe_2O_3$, CuO and ZnO were weighed in proportions of 60 mol %, 20 mol % and 20 mol %, respectively, and blended in a ball mill, followed by calcination. On the other hand, $Fe_2O_3$, $SrCO_3$ and ZnO were weighed in proportions of 82 mol %, 10 mol % and 8 mol %, respectively, and blended in a ball mill, followed by calcination. These calcined materials were respectively pulverized in a ball mill and blended in a weight ratio of the former to the latter of 2:1. To the mixture were further added polyvinyl alcohol, an anti-foaming agent and a dispersant to form a slurry, which was then formed into particles by a spray drier, dried, calcined and classified to obtain carrier particles having an average particle size of 55 μm, The carrier particles were almost spherical (sphericity: 1.10). As a result of X-ray diffraction analysis and fluorescent X-ray analysis, the carrier showed a spinel phase (Cu—Zn-ferrite)/magnetoplumbite phase (Sr ferrite) ratio of about 2:1 substantially equal to the starting material ratio. The carrier particles showed a bulk density of 2.32 g/cm$^3$ and a resistivity of $6.2\times10^9$ Ω.cm. After being magnetically saturated in a magnetic field of 10 kilo-oersted, the carrier showed magnetic properties of $\sigma_{1000}$=142 emu/cm$^3$, $\sigma_r$104 emu/cm$^3$, $\sigma_{300}$122 emu/cm$^3$, Hc=260 oersted, and $(\sigma_{1000}-\sigma_{300})/\sigma_{1000}$=0.14.

The carrier particles were then coated with about 0.8 wt. % of styrene/2-ethylhexyl methacrylate (50/50) copolymer by fluidized bed coating. The resin-coated carrier showed a resistivity of $9.5\times10^{12}$ Ω.cm and magnetic properties substantially identical to those of the carrier before coating.

A cyan toner was prepared from the following materials.

| | |
|---|---|
| Polyester resin formed by condensation between propoxidized bisphenol and fumaric acid | 100 wt. parts |
| Phthalocyanine pigment | 5 " |
| Di-tert-butylsalicylic acid chromium complex salt | 4 " |

The above materials were preliminarily blended sufficiently, melt-kneaded and, after cooling, coarsely crushed into particles of about 1–2 μm, followed further by fine pulverization by an air jet pulverizer and classification to obtain a negatively chargeable cyan-colored powder (cyan toner) having a weight-average particle size of 8.4 μm.

100 wt. parts of the cyan toner was blended with 0.8 wt. part of silica fine powder treated with hexamethyldisilazane for hydrophobicity treatment to prepare a cyan toner carrying silica fine powder attached to the surface thereof (agglomeration degree =about 13%).

Figure 3:
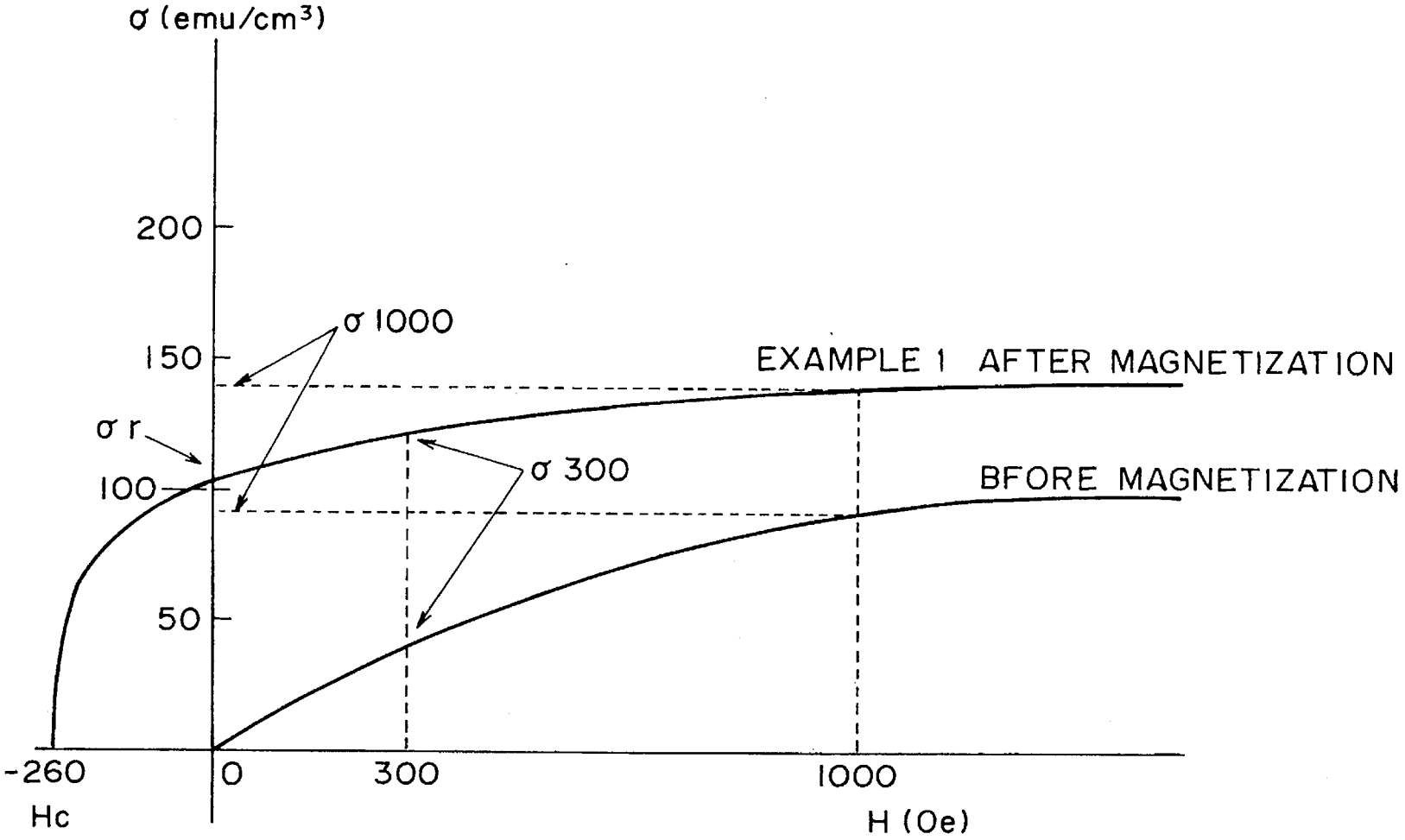
FIG. 3 is a graph showing two magnetization curves of the carrier used in Example 1 before and after magnetization, respectively.

The above resin-coated carrier was placed for several seconds in a magnetic field of 10 kilo-oersted for magnetization and blended with the cyan toner to obtain a two-component developer having a toner content of 5 wt. %. The magnetic properties of the carrier before and after the magnetization are shown in FIG. 3. The developer was charged in a remodeled commercially available full-color laser copying machine ("CLC-500", mfd. by Canon K.K.) and used for image formation. FIG. 6 schematically illustrates the developing device and the photosensitive drum around the developing zone in the remodeled copying machine. The gap between the developing sleeve and the developer regulating member was 400 μm, the developing sleeve and the photosensitive member were rotated at a peripheral speed ratio of 1.3:1 with a peripheral speed of 300 mm/sec for the developing sleeve. The developing conditions included a developing pole magnetic field strength of 1000 oersted, an alternating electric field of 2000 Vpp, a frequency of 3000 Hz, and a spacing of 500 μm between the sleeve and the photosensitive drum. As a result of microscopic observation, the magnetic brush ears near the magnetic pole were dense and short, and the magnetic brush on the sleeve contacted the photosensitive drum at the developing station.

The resultant images showed a sufficient density at a solid image part, were free from coarse images and showed particularly good reproducibility of halftone parts and line images. No toner adhesion was observed either at the image parts or the non-image parts. After 30 minutes of blank rotation of the developing sleeve at 200 rpm, image formation was again performed, whereby very good images were obtained with no problem at all regarding image qualities and no carrier adhesion.

COMPARATIVE EXAMPLE 1

$Fe_2O_3$ and $SrCO_3$ were weighed in a molar ratio of 85 mol % and 15 mol %, respectively and blended in a ball mill. The blend powder was calcined, pulverized and made into a slurry, which was then formed into particles and then sintered. The sintered particles were classified by a pneumatic classifier to obtain carrier particles having an average particle size of 59 μm. As a result of X-ray diffraction analysis and fluorescent X-ray analysis, the carrier showed a spinel phase (Cu—Zn-ferrite)/magnetoplumbite phase (Sr ferrite) ratio of about 2:1 substantially equal to the starting material ratio. The carrier particles showed a bulk density of 2.01 g/cm$^3$ and a resistivity of $9.5\times10^8$ Ω.cm. After being magnetically saturated in a magnetic field of 10 kilo-oersted, the carrier showed magnetic properties of $\sigma_{1000}$=101 emu/cm$^3$, $\sigma_r$=76 emu/cm$^3$, $\sigma_{300}$=89 emu/cm$^3$, Hc=2040 oersted and $(\sigma_{1000}-\sigma_{300})/\sigma_{1000}$=0.12.

The thus-obtained carrier was surface-coated with a resin in the same manner as in Example 1. The resin-coated carrier showed a resistivity of $3.5\times10^{12}$ ohm.cm. The resin-coated carrier was then magnetically saturated in the same manner as in Example 1 and blended with the same toner as in Example 1 to obtain a two-component developer.

The developer was used for image formation in the same manner as in Example 1, whereby the developer showed a poor fluidity on the developing sleeve because of the self-agglomeratability of the carrier, thus failing to effect mixing with the toner and conveyance of the developer in a satisfactory manner.

COMPARATIVE EXAMPLE 2

Carrier particles having an average particle size of 52 μm were prepared in the same manner as in Example 1 except that the spinel phase material (Cu—Zn ferrite) and the magnetoplumbite phase material (Sr ferrite) were blended in a ratio of 1:2. The carrier particles were almost spherical. As a result of X-ray diffraction analysis and fluorescent X-ray analysis, the carrier showed a spinel phase (Cu—Zn-ferrite)/magnetoplumbite phase (Sr ferrite) ratio of about 1:2 substantially equal to the starting material ratio. The carrier particles showed a bulk density of 2.07 g/cm$^3$ and a resistivity of $5.1\times10^9$ Ω.cm. After being magnetically saturated in a magnetic field of 10 kilo-oersted, the carrier showed magnetic properties of $\sigma_{1000}$=117 emu/cm$^3$, $\sigma_r$94 emu/cm$^3$, $\sigma_{300}$=106 emu/cm$^3$, Hc=1090 oersted, and $(\sigma_{1000}-\sigma_{300})/\sigma_{1000}$= 0.09.

The thus-obtained carrier was surface-coated with a resin in the same manner as in Example 1. The resin-coated carrier showed a resistivity of $7.5\times10^{12}$ ohm.cm. The resin-coated carrier was then magnetically saturated in the same manner as in Example 1 and blended with the same toner as in Example 1 to obtain a two-component developer.

The developer was used for image formation in the same manner as in Example 1, whereby the developer showed a poor fluidity on the developing sleeve because of the self-agglomeratability of the carrier, thus failing to effect mixing with the toner and conveyance of the developer in a satisfactory manner similarly as in Comparative Example 1.

COMPARATIVE EXAMPLE 3

$Fe_2O_3$, ZnO and CuO were weighed in molar proportions of 62 mol %, ZnO 16 mol % and 22 mol %, respectively, and blended in a ball mill. From the blended material, carrier particles having an average particle size of 50 μm were obtained in the same manner as in Comparative Example 1. These carrier particles were almost spherical. The carrier particles showed a bulk density of 2.77 g/cm$^3$ and a resistivity of $4.0\times10^9$ Ω.cm. After being magnetically saturated in a magnetic field of 10 kilo-oersted, the carrier showed magnetic properties of $\sigma_{1000}$=214 emu/cm$^3$, $\sigma_r$2 emu/cm$^3$, $\sigma_{300}$=113 emu/cm$^3$, Hc=10 oersted, and $(\sigma_{1000}-\sigma_{300})/\sigma_{1000}$=0.47.

The thus-obtained carrier was surface-coated with a resin in the same manner as in Example 1. The resin-coated carrier showed a resistivity of $3.2\times10^{12}$ ohm.cm. The resin-coated carrier was blended with the same toner as in Example 1 to obtain a two-component developer.

The developer was used for image formation in the same manner as in Example 1, whereby the developer showed a good fluidity on the developing sleeve and good conveyability. However, the magnetic brush in the vicinity of the magnetic pole was observed to be sparse, thus resulting in coarseness at halftone parts. After blank rotation in the same manner as in Example 1, coarseness was observed particularly at the halftone parts.

EXAMPLE 2

$Fe_2O_3$, CuO and ZnO were weighed in proportions of 50 mol %, 20 mol % and 30 mol %, respectively, and blended in a ball mill, followed by calcination. On the other hand, $Fe_2O_3$, BaO and ZnO were weighed in proportions of 85 mol %, 12 mol % and 3 mol %, respectively, and blended in a ball mill, followed by calcination. These calcined materials were respectively pulverized in a ball mill and blended in a weight ratio of the former to the latter of 1.5:1. To the mixture were further added polyvinyl alcohol, an anti-foaming agent and a dispersant to form a slurry, which was then formed into particles by a coating device ("SPIRA COTA"), dried, calcined and classified to obtain carrier particles having an average particle size of 45 μm. The carrier particles were almost spherical. As a result of X-ray diffraction analysis and fluorescent X-ray analysis similarly as in Example 1, the carrier showed a spinel phase (Cu—Zn-ferrite)/magnetoplumbite phase (Sr ferrite) ratio of 1.6:1 substantially equal to the starting material ratio. The carrier particles showed a bulk density of 2.30 g/cm$^3$ and a resistivity of $9.2\times10^9$ Ω.cm. After being magnetically saturated in a magnetic field of 10 kilo-oersted, the carrier showed magnetic properties of $\sigma_{1000}$=67 emu/cm$^3$, $\sigma_r$=36 emu/cm$^3$, $\sigma_{300}$=52 emu/cm$^3$, Hc=170 oersted, and $(\sigma_{1000}-\sigma_{300})/\sigma_{1000}$=0.22.

The thus-obtained carrier was surface coated with a resin in the same manner as in Example 1. The resin-coated carrier showed a resistivity of $1.3\times10^{12}$ Ω.cm.

The resin-coated carrier was then magnetized in the same manner as in Example 1 and blended with the same toner as in Example 1 to obtain a two-component developer. The developer was used for image formation in the same manner as in Example 1. As a result, the magnetic brush on the developing sleeve was dense, and good images were formed free from coarseness at halftone parts and with good reproducibility of thin line parts. Further, in spite of the small $\sigma_{1000}$ value, no carrier adhesion was observed at either the image part or the non-image part. Images formed after the blank rotation showed a sufficient density at a solid part, a good halftone part free from coarseness and no carrier adhesion.

COMPARATIVE EXAMPLE 4

$Fe_2O_3$, $SrCO_3$, ZnO and CuO were weighed in proportions of 60 mol %, 3 mol %, 21 mol % and 16 mol % respectively, and blended in a ball mill. From the blended material, carrier particles having an average particle size of 52 μm were obtained. The carrier particles were almost spherical and showed a spinel phase (Cu—Zn ferrite)/magnetoplumbite phase (Sr ferrite) ratio of about 15:1 as a result of X-ray diffraction measurement and fluorescent X-ray measurement. The carrier particles showed a bulk density of 2.32 g/cm$^3$ and a resistivity of $1\times10^9$ Ω.cm. After being magnetically saturated in a magnetic field of 10 kilo-oersted, the carrier showed magnetic properties of $\sigma_{1000}$=58 emu/cm$^3$, $\sigma_r$=6 emu/cm$^3$, $\sigma_{300}$=20 emu/cm$^3$, Hc=60 oersted and $(\sigma_{1000}-\sigma_{300})/\sigma_{1000}$=0.66.

The thus-obtained carrier was surface-coated with a resin in the same manner as in Example 1. The resin-coated carrier showed a resistivity of $1.5\times10^{12}$ ohm.cm. The resin-coated carrier was then magnetically saturated in the same manner as in Example 1 and blended with the same toner as in Example 1 to obtain a two-component developer.

The developer was used for image formation in the same manner as in Example 1. As a result, because of a small $\sigma_{1000}$ value, the magnetic brush on the developing sleeve was dense, and the result images showed halftone parts free from coarseness and very excellent reproducibility of thin lines, but carrier adhesion was observed at non-image parts because of a weak magnetization at 0–300 oersted, and correspondingly toner fog was observed at the non-image parts.

EXAMPLE 3

Fe, Al, Ni and Co were mixed in proportions of 61 mol %, 9 mol %, 15 mol % and 15 mol %, respectively, and the mixture in a molten state was atomized with water to obtain carrier particles, which were then classified by a pneumatic classifier to obtain carrier particles having an average particle size of 42 μm. The carrier particles were almost spherical and a resistivity of $8.2\times10^2$ ohm.cm. The carrier particles showed magnetic properties of $\sigma_{1000}$ =89 emu/cm$^2$, $\sigma_r$37 emu/cm$^3$, $\sigma_{300}$60 emu/cm$^3$, Hc=165 oersted, and $(\sigma_{1000}-\sigma_{300})/\sigma_{1000}$=0.33.

The thus-obtained carrier was surface coated with a resin in the same manner as in Example 1. The resin-coated carrier showed a resistivity of $2\times10^9$ ohm. cm.

The resin-coated carrier was then magnetized in the same manner as in Example 1 and blended with the same toner as in Example 1 to obtain a two-component developer. The developer was used for image formation in the same manner as in Example 1. As a result, the magnetic brush on the developing sleeve was dense, and good images were formed free from coarseness at halftone parts and with good reproducibility of thin line parts. Further, no carrier adhesion was observed at either the image part or the non-image part. Images formed after the blank rotation showed a good halftone part free from coarseness, image qualities substantially identical to those at the initial stage and no carrier adhesion.

EXAMPLE 4

A two-component developer was prepared by mixing the resin-coated carrier used in Example 1 and a toner prepared in the following manner.

| | |
|---|---|
| Polystyrene-type resin | 100 wt. parts |
| Carbon black | 5 " |
| Di-tert-butylsalicylic acid chromium complex salt | 4 " |

From the above materials, a toner having a weight-average particle size of 8.0 μm was prepared in the same manner as in Example 1.

100 wt. parts of the toner was blended with 0.7 wt. part of silica fine powder treated with hexamethyldisilazane for hydrophobicity treatment by a Henschel mixer to form a black toner carrying silica fine powder attached to the surface thereof.

The toner and the resin-coated carrier used in Example 1 were blended with each other to obtain a two-component developer having a toner concentration of 6%. The developer was used for image formation in the same manner as in Example 1.

The resultant images showed a sufficient density at solid image parts, were free from coarseness and showed uniform reproducibility of halftone parts and particularly good reproducibility of line images. Further, no carrier adhesion was observed either at images parts or non-image parts. The results of image formation after the blank rotation were similarly good as in Example 1.

The physical properties of the carriers prepared above are shown in Table 1 and the evaluation results thereof are shown in Table 2 wherein the respective marks indicate the following levels of performances:

⊙: very good, ○: good,

Δ: fair, X: not acceptable.

TABLE 1

| Example No. | Size (μm) | Bulk density (g/cm³) | Magnetic material | Hc (öe) | $\sigma_{1000}$ (emu/cm³) | $\sigma_{300}$ (emu/cm³) | $\sigma_r$ (emu/cm³) | $\sigma_{1000}-\sigma_{300}/\sigma_{1000}$ | Resistivity (Ω · cm) | Sp/Mp ratio* | Sphericity |
|---|---|---|---|---|---|---|---|---|---|---|---|
| Ex. 1 | 55 | 2.32 | Cu—Zn ferrite Sr ferrite | 260 | 142 | 122 | 104 | 0.14 | $9.5 \times 10^{12}$ | 2:1 | 1.10 |
| Comp. Ex. 1 | 59 | 2.01 | Sr ferrite | 2040 | 101 | 89 | 76 | 0.12 | $3.5 \times 10^{12}$ | 0:1 | 1.18 |
| Comp. Ex. 2 | 52 | 2.07 | Cu—Zn ferrite Sr ferrite | 1090 | 117 | 106 | 94 | 0.09 | $7.5 \times 10^{12}$ | 1:2 | 1.20 |
| Comp. Ex. 3 | 50 | 2.77 | Cu—Zn ferrite | 10 | 214 | 113 | 2 | 0.47 | $3.2 \times 10^{12}$ | 1:0 | 1.06 |
| Ex. 2 | 45 | 2.30 | Cu—Zn ferrite Ba ferrite | 170 | 67 | 52 | 36 | 0.22 | $1.3 \times 10^{12}$ | 1.6:1 | 1.11 |
| Comp. Ex. 4 | 52 | 2.32 | Cu—Zn ferrite | 60 | 58 | 20 | 6 | 0.66 | $1.5 \times 10^{12}$ | 15:1 | 1.10 |
| Ex. 3 | 42 | 2.96 | Fe—Al—Ni—Co | 165 | 89 | 60 | 37 | 0.33 | $2.0 \times 10^{9}$ | — | 1.21 |

*spinel phase/magnetoplumbite phase ratio

TABLE 2

| | | Initial images | | | | | Images after 30 min. of blank rotation | | | | |
|---|---|---|---|---|---|---|---|---|---|---|---|
| Example No. | Developer fluidity | Solid part density | Solid part uniformity | Halftone reproducibility | Line reproducibility | Carrier adhesion | Solid part density | Solid part uniformity | Halftone reproducibility | Line reproducibility | Carrier adhesion |
| Ex. 1 | ○ | ⊙ | ⊙ | ⊙ | ⊙ | ⊙ | ⊙ | ○ | ○ | ○ | ⊙ |
| Comp. Ex. 1 | X | | | — | | | | | — | | |
| Comp. Ex. 2 | X | | | — | | | | | — | | |
| Comp. Ex. 3 | ⊙ | ○ | Δ | Δ | ○ | ⊙ | ○ | X | X | Δ | ⊙ |
| Ex. 2 | ⊙ | ⊙ | ⊙ | ⊙ | ⊙ | ○ | ⊙ | ⊙ | ○ | ⊙ | ○ |
| Comp. Ex. 4 | ⊙ | ⊙ | ⊙ | ⊙ | ⊙ | X | ⊙ | ⊙ | ○ | ⊙ | X |
| Ex. 3 | ⊙ | ⊙ | ⊙ | ⊙ | ⊙ | ○ | ⊙ | ⊙ | ○ | ○ | ○ |
| Ex. 4 | ○ | ⊙ | ⊙ | ⊙ | ⊙ | ⊙ | ⊙ | ○ | ○ | ○ | ⊙ |

EXAMPLE 5

| | |
|---|---|
| Styrene/isobutyl acrylate (80/20) copolymer | 10 wt. parts |
| Plate-like Sr-ferrite ($Fe_2O_3$/SrO = 80/20 (mol): average longer diameter (D1) = ca. 0.8 μm, average shorter diameter (Ds) = ca. 0.6 μm, average thickness (Tav.) = ca. 0.2 μm) | 20 wt. parts |
| Spherical Cu—Zn ferrite ($Fe_2O_3$/CuO/ZnO = 70/15/15; average particle size (Dav.) = ca. 0.8 μm) | 50 wt. parts |

The above materials were preliminarily blended sufficiently in a Henschel mixer, melt-knead at least three times by a three-roll mill and, after cooling, coarsely crushed by a hammer mill into a particle size of about 2 mm, followed further by line pulverization by an air jet pulverizer into a particle size of about 50 μm. Then, the pulverized product was then mechanically sphered in a mechanomill ("MM-10", mfd. by Okada Seiko K.K.). The sphered particles were further classified to obtain magnetic material-dispersed resin particles (carrier core particles), which showed a particle size of 50 μm and a resistivity of $1.2\times10^{10}$ ohm.cm. As a result of X-ray diffraction analysis and fluorescent X-ray analysis, the spinel phase (Cu—Zn ferrite)/magnetoplumbite phase (Sr ferrite) ratio was 2.5:1 substantially identical to the starting material ratio.

The core particles were then coated with about 0.8 wt. % of styrene/2-ethylhexyl methacrylate (50/50) copolymer by fluidized bed coating.

The properties of the coated carrier are shown in Table 3 appearing hereinafter. The magnetic properties were measured after magnetically saturating the coated carrier in a magnetic field of 10 kilo-oersted.

A cyan toner was prepared from the following materials.

| | |
|---|---|
| Polyester resin formed by condensation between propoxidized bisphenol and fumaric acid | 100 wt. parts |
| Phthalocyanine pigment | 5 " |
| Di-tert-butylsalicylic acid chromium complex salt | 4 " |

The above materials were preliminarily blended sufficiently, melt-kneaded three times by a three-roll mill and, after cooling, coarsely crushed into particles of about 1–2 μm, followed further by fine pulverization by an air jet pulverizer and classification to obtain a negatively chargeable cyan-colored powder (cyan toner) having a weight-average particle size of 8.2 μm.

100 wt. parts of the cyan toner was blended with 0.4 wt. part of silica fine powder treated with hexamethyldisilazane for hydrophobicity treatment to prepare a cyan toner carrying silica fine powder attached to the surface thereof.

The above coated carrier was placed for several seconds in a magnetic field of 10 kilo-oersted for magnetization and blended with the cyan toner in an environment of 23° C./60% RH to obtain a two-component developer having a toner content of 5 wt. %. The developer was charged in a remodeled commercially available full-color laser copying machine ("CLC-500", mfd. by Canon K.K.) and used for image formation in the same manner as in Example 1. The gap between the developing sleeve and the developer regulating member was 400 μm, the developing sleeve and the photosensitive member were rotated at a peripheral speed ratio of 1.3:1 with a peripheral speed of 300 mm/sec for the developing sleeve. The developing conditions included a developing pole magnetic field strength of 1000 oersted, an alternating electric field of 2000 Vpp, a frequency of 3000 Hz, and a spacing of 500 μm between the sleeve and the photosensitive drum. As a result of microscopic observation, the magnetic brush ears near the magnetic pole were dense and short.

The resultant images showed a sufficient density at a solid image part, were free from coarse images and showed particularly good reproducibility of halftone parts and line images. No toner adhesion was observed either at the image parts or the non-image parts. After 40 minutes of blank rotation of the developing sleeve at 200 rpm, image formation was again performed, whereby very good images were obtained with no problem at all regarding image qualities and no carrier adhesion.

COMPARATIVE EXAMPLE 5

| | |
|---|---|
| Styrene-acrylic acid copolymer | 30 wt. parts |
| Plate-like Sr ferrite ($Fe_2O_3$/SrO/ZnO = 70/20/10, D1 = ca. 0.8 μm, Ds = ca. 0.6 μm, Tav. = ca. 0.2 μm) | 70 wt. parts |

The above materials were formed into particles in the same manner as in Example 5 to obtain magnetic material-dispersed carrier core particles. The core particles showed an average particle size of 54 μm and a resistivity of $3.7\times10^{10}$ ohm.cm. The core particles were surface-coated with the same resin in the same manner as in Example 5. The properties of the coated carrier are shown in Table 3.

The coated carrier was subjected to evaluation in the same manner as in Example 5. As a result, the ears of the developer on the sleeve were dense, and no carrier adhesion was observed. However, due to the self-agglomeratability of the coated carrier, the fluidity of the developer on the developing sleeve was poor, and it was difficult to take up the developer under stirring, whereby high-quality images could not be obtained.

COMPARATIVE EXAMPLE 6

$Fe_2O_3$, ZnO and CuO were weighed in proportions of 60 mol %, 23 mol % and 17 mol %, respectively, and blended in a ball mill. The blended material was calcined, pulverized and made into a slurry, which was then formed into particles and then calcined. The calcined particles were classified by a pneumatic classifier to obtain carrier core particles having an average particle size of 49 μm. The core particles were almost spherical and showed a resistivity of $6.7\times10^{9}$ ohm.cm.

The core particles were surface-coated with the same resin in the same manner as in Example 5. The properties of the coated carrier are shown in Table 3.

The coated carrier was subjected to evaluation in the same manner as in Example 5. As a result, no carrier adhesion was caused. However, the ears of the developer on the developing sleeve were coarse and, while the initial images were good and free from carrier adhesion, halftone images after the blank rotation were coarse and accompanied with disturbance of lines.

EXAMPLE 6

| | |
|---|---|
| Styrene/isobutyl acrylate (80/20) copolymer | 30 wt. parts |
| Fe—Al—Ni—Co (60/8/15/17 (mol) alloy powder (Dav. = 1 μm)) | 70 wt. parts |

The above materials were formed into particles in the same manner as in Example 5 to obtain magnetic material-dispersed resin particles (core particles).

The core particles showed a particle size of 47 μm, and were coated with the same resin in the same manner as in Example 5. The properties of the coated carrier are shown in Table 3. The coated carrier was evaluated in the same manner as in Example 5, whereby good images were obtained with no carrier adhesion both in the initial stage and after the blank rotation.

COMPARATIVE EXAMPLE 7

| | |
|---|---|
| Styrene/isobutyl acrylate copolymer | 30 wt. parts |
| Cu—Zn ferrite ($F_2O_3$/CuO/ZnO = 70/23/7 (mol)) | 70 wt. parts |

From the above materials magnetic material-dispersed carrier core particles were obtained in the same manner as in Example 5.

The core particles showed a particle size of 46 μm and a resistivity of $6.8\times10^{10}$ ohm.cm. The core particles were surface-coated with the same resin in the same manner as in Example 5. The properties of the coated carrier are shown in Table 3.

The coated carrier was subjected to evaluation in the same manner as in Example 5. As a result, the ears on the sleeve were dense and good images were obtained both in the initial stage and after the blank rotation, whereas carrier adhesion was caused.

EXAMPLE 7

80 parts of styrene monomer, 20 parts of isobutyl acrylate, 200 parts of Sr ferrite.($Fe_2O_3$/SrO =80/20 by mol) and 500 parts of Cu—Zn ferrite ($Fe_2O_3$/CuO/ZnO=70/15/15 by mol) were placed in a vessel, heated therein to 70° C. and held at 70° C., and azobisisobutyronitrile was added thereto to form a polymerizable mixture, which was then charged into a 2 liter-flask containing 1.2 liter of 1% PVA (polyvinyl alcohol) aqueous solution and stirred by a homogenizer at 70° C. for 10 min. to form the mixture into the form of particles. Then, while being stirred by a paddle stirrer, the content was subjected to suspension polymerization at 70° C. for 10 hours. After the polymerization, the product was cooled, recovered, washed, filtered and dried to obtain magnetic material dispersed resinous carrier core particles. The core particles showed an average particle size of 52 μm and a resistivity of $1.5\times10^{10}$ ohm.cm.

The core particles were coated with the same resin in the same manner as in Example 5. The coated carrier was evaluated in the same manner as in Example 5, whereby good results were obtained.

EXAMPLE 8

| | |
|---|---|
| Styrene-isobutyl acrylate copolymer | 30 wt. parts |
| Magnetic Ba ferrite ($Fe_2O_3$/BaO = 7/3 by mol) | 30 " |
| Magnetic Cu—Zn ferrite ($Fe_2O_3$/CuO/ZnO = 6/2/2 by mol) | 40 " |

The above materials were melt-kneaded, pulverized and classified in the same manner as in Example 5 but without the sphering treatment to obtain magnetic material-dispersed resin particles (core particles).

The core particles showed a particle size of 52 μm and a resistivity of $6.1\times10^{10}$ ohm.cm, and were coated with the same resin in the same manner as in Example 5. The properties of the coated carrier are shown in Table 3. The coated carrier was evaluated in the same manner as in Example 5, whereby good results were obtained.

EXAMPLE 9

| | |
|---|---|
| Phenol | 10 wt. parts |
| Formalin (formaldehyde = ca. 37%, methanol = ca. 5%, the remainder: water) | 5 wt. parts |
| Sr ferrite ($Fe_2O_3$/SrO/CaO = 80/17/3 by mol) | 25 wt. parts |
| Cu—Zn ferrite ($Fe_2O_3$/CuO/ZnO = 60/15/25 by mol) | 60 wt. parts |

The above materials were stirred in an aqueous phase containing ammonia (basic catalyst) and calcium fluoride (polymerization stabilizer), gradually heated to 80° C. and subjected to 2 hours of polymerization. After filtration and washing, the resultant polymerizate particles were classified to obtain magnetic material-dispersed resin particles (core particles).

The core particles showed a particle size of 46 μm and a resistivity of $2.5\times10^{9}$ ohm.cm, and were coated with the same resin in the same manner as in Example 5, whereby a good coating state was obtained. The properties of the coated carrier are shown in Table 3. The coated carrier was evaluated in the same manner as in Example 5, whereby good images were obtained in the successive image forming test without causing carrier adhesion.

EXAMPLE 10

Carrier core particles were prepared by polymerization in the same manner as in Example 9 except that 70 wt. % of $\gamma$-$Fe_2O_3$ was used as the magnetic material together with the remainder of the resin precursor. The resultant core particles showed a particle size of 49 μm and a resistivity of $8.9\times10^{5}$ ohm.cm, and were coated with the same resin in the same manner as in Example 5, whereby a good coating state similarly as in Example 8 was obtained. The properties of the coated carrier are shown in Table 3. The coated carrier was evaluated in the same manner as in Example 5, whereby good images were obtained in the successive image forming test without causing carrier adhesion.

EXAMPLE 11

| | |
|---|---|
| Styrene-acrylic resin | 100 wt. parts |
| Carbon black | 6 wt. parts |
| Di-tert-butylsalicylic acid chromium complex salt | 4 wt. parts |

From the above materials, a toner having a weight-average particle size of 8.0 μm was prepared in the same manner as in Example 5.

100 wt. parts of the toner was blended with 1.0 wt. part of silica fine powder treated with hexamethyldisilazane for hydrophobicity treatment by a Henschel mixer to form a black toner carrying silica fine powder attached to the surface thereof.

The carrier core particles of Example 5 were used as they were without being further coated and, after being magnetized in a magnetic field of 10 kilo-oersted, were blended with the above black toner to obtain a two-component developer having a toner concentration of 5 wt. %. The developer was evaluated in the same manner as in Example 5, whereby good images were obtained with no carrier adhesion both in the initial stage and after the blank rotation similarly as in Example 5.

TABLE 3

| Example No. | Size (μm) | Bulk density (g/cm$^3$) | Magnetic material | Hc (öe) | $\sigma_{1000}$ (emu/cm$^3$) | $\sigma_{300}$ (emu/cm$^3$) | $\sigma_r$ (emu/cm$^3$) | $\lvert\sigma_{1000}-\sigma_{300}\rvert/\sigma_{1000}$ | Resistivity (Ω · cm) | Sp/Mp ratio* | Sphericity |
|---|---|---|---|---|---|---|---|---|---|---|---|
| Ex. 5 | 1.69 | 50 | Sr ferrite Cu—Zn ferrite | 220 | 103 | 85 | 58 | 0.17 | $2.3 \times 10^{13}$ | 2.5:1 | 1.25 |
| Comp. Ex. 5 | 1.66 | 54 | Ba ferrite | 1700 | 114 | 93 | 78 | 0.18 | $6.2 \times 10^{13}$ | 0:1 | 1.27 |
| Comp. Ex. 6 | 2.43 | 49 | Cu—Zn ferrite carrier | 3 | 203 | 110 | 1 | 0.46 | $2.3 \times 10^{3}$ | 1:0 | 1.05 |
| Ex. 6 | 1.72 | 47 | Fe—Al—Ni—Co alloy power (60:8:15:17) | 130 | 68 | 50 | 30 | 0.37 | $6.7 \times 10^{11}$ | — | 1.29 |
| Comp. Ex. 7 | 1.63 | 46 | Cu—Zn ferrite | 3 | 65 | 25 | 2 | 0.61 | $3.4 \times 10^{13}$ | 1:0 | 1.26 |
| Ex. 7 | 1.70 | 52 | Same as in Ex. 5 | 220 | 101 | 68 | 54 | 0.33 | $3.1 \times 10^{13}$ | 2.5:1 | 1.08 |
| Ex. 8 | 1.64 | 52 | Ba ferrite Cu—Zn ferrite | 209 | 98 | 72 | 53 | 0.27 | $5.3 \times 10^{13}$ | 1.5:1 | 1.29 |
| Ex. 9 | 1.88 | 46 | Sr ferrite Cu—Zn ferrite | 190 | 97 | 80 | 54 | 0.18 | $3.9 \times 10^{13}$ | 3:1 | 1.07 |
| Ex. 10 | 1.67 | 49 | $\gamma$-$Fe_2O_3$ | 240 | 76 | 59 | 46 | 0.22 | $5.4 \times 10^{13}$ | 1:0 | 1.10 |
| Ex. 11 | 1.69 | 50 | Sr ferrite Cu—Zn ferrite | 220 | 103 | 85 | 58 | 0.17 | $1.2 \times 10^{10}$ | 2.5:1 | 1.25 |

*spinel phase/magnetoplumbite phase ratio

TABLE 4

| | Initial images | | | | Images after 40 min. of blank rotation | | | |
|---|---|---|---|---|---|---|---|---|
| Example No. | Solid part uniformity | Halftone reproducibility | Line reproducibility | Carrier adhesion | Solid part uniformity | Halftone reproducibility | Line reproducibility | Carrier adhesion |
| Ex. 5 | ◎ | ◎ | ◎ | ◎ | ◎ | ◎ | ◎ | ◎ |
| Comp. Ex. 5 | Δ | Δ | Δ | ○ | — | — | — | — |
| Comp. Ex. 6 | ○ | ○ | ○ | ○ | X | Δ | X | ○ |
| Ex. 6 | ◎ | ◎ | ◎ | ◎ | ◎ | ◎ | ◎ | ◎ |
| Comp. Ex. 7 | ◎ | ◎ | ◎ | X | ◎ | ◎ | ◎ | X |
| Ex. 7 | ◎ | ◎ | ◎ | ◎ | ◎ | ◎ | ◎ | ◎ |
| Ex. 8 | ◎ | ◎ | ◎ | ◎ | ◎ | ◎ | ◎ | ◎ |
| Ex. 9 | ◎ | ◎ | ◎ | ◎ | ◎ | ◎ | ◎ | ◎ |
| Ex. 10 | ◎ | ◎ | ◎ | ◎ | ◎ | ◎ | ◎ | ◎ |
| Ex. 11 | ○ | ◎ | ◎ | ○ | ○ | ◎ | ◎ | ○ |

◎: Excellent,
○: Good,
Δ: Fair,
X: Poor

EXAMPLE 12

| | |
|---|---|
| Styrene/isobutylacrylate (80/20) copolymer | 28 wt. parts |
| 3% Zn-doped $\gamma$-$Fe_2O_3$ magnetic fine powder ($D\underline{l}$ = 1.0 μm, Ds = 0.12 μm) | 72 wt. parts |

The above materials were preliminarily blended sufficiently in a Henschel mixer, melt-knead at least two times by a three-roll mill and, after cooling, coarsely crushed by a hammer mill into chips with a particle size of about 5 mm. The chips were then injection-molded for orientation of the magnetic fine powder and then again subjected to cooling and crushing into a particle size of about 2 mm, followed further by fine pulverization by an air jet pulverizer into a particle size of about 50 μm. Then, the pulverized product was then mechanically sphered in a mechanomill ("MM-10", mfd. by Okada Seiko K.K.). The sphered particles were further classified to obtain magnetic material-dispersed resin particles (carrier core particles), which showed a particle size of 48 μm and a resistivity of $2.2\times10^{10}$ ohm.cm. As a result of sectional observation through an FE-SEM, the core particles showed a degree of orientation of the magnetic fine particles of 55%.

The core particles were then coated with about 0.8 wt. % of styrene/2-ethylhexyl methacrylate (50/50) copolymer by fluidized bed coating.

The properties of the coated carrier are shown in Table 5 appearing hereinafter. The magnetic properties were measured after magnetically saturating the coated carrier in a magnetic field of 10 kilo-oersted.

A cyan toner was prepared from the following materials.

| | |
|---|---|
| Polyester resin formed by condensation between propoxidized bisphenol and fumaric acid | 100 wt. parts |
| Phthalocyanine pigment | 5 wt. parts |
| Di-tert-butylsalicylic acid chromium complex salt | 4 wt. parts |

The above materials were preliminarily blended sufficiently, melt-kneaded three times by a three-roll mill and, after cooling, coarsely crushed into particles of about 1–2 μm, followed further by fine pulverization by an air jet pulverizer and classification to obtain a negatively chargeable cyan-colored powder (cyan toner) having a weight-average particle size of 8.2 μm.

100 wt. parts of the cyan toner was blended with 0.4 wt. part of silica fine powder treated with hexamethyldisilazane for hydrophobicity treatment to prepare a cyan toner carrying silica fine powder attached to the surface thereof.

The above coated carrier was placed for several seconds in a magnetic field of 10 kilo-oersted for magnetization and blended with the cyan toner in an environment of 23° C./60% RH to obtain a two-component developer having a toner content of 5 wt. %. The developer was charged in a remodeled commercially available full-color laser copying machine ("CLC-500", mfd. by Canon K.K.) and used for image formation. FIG. 6 schematically illustrates the developing device and the photosensitive drum around the developing zone in the remodeled copying machine. The gap between the developing sleeve and the developer regulating member was 400 μm, the developing sleeve and the photosensitive member were rotated at a peripheral speed ratio of 1.3:1 with a peripheral speed of 300 mm/sec for the developing sleeve. The developing conditions included a developing pole magnetic field strength of 1000 oersted, an alternating electric field of 2000 Vpp, a frequency of 3000 Hz, and a spacing of 500 μm between the sleeve and the photosensitive drum. As a result of microscopic observation, the magnetic brush ears near the magnetic pole were dense and short.

The resultant images showed a sufficient density at a solid image part, were free from coarse images and showed particularly good reproducibility of halftone parts and line images. No toner adhesion was observed either at the image parts or the non-image parts. After 40 minutes of blank rotation of the developing sleeve at 200 rpm, image formation was again performed, whereby very good images were obtained with no problem at all regarding image qualities and no carrier adhesion.

COMPARATIVE EXAMPLE 8

| | |
|---|---|
| Styrene/isobutyl acrylate (80/20) | 30 wt. parts |
| Spherical Cu—Zn ferrite magnetic fine particles ($Fe_2O_3$/CuO/ZnO = 70/23/7 by mol, Dav. = 0.8 μm) | 70 wt. parts |

The above materials were formed into particles in the same manner as in Example 12 to obtain magnetic material-dispersed carrier core particles. The core particles showed an average particle size of 46 μm and a resistivity of $6.8\times10^{10}$ ohm.cm. The core particles were surface-coated with the same resin in the same manner as in Example 12. The properties of the coated carrier are shown in Table 5.

The coated carrier was subjected to evaluation in the same manner as in Example 12. As a result, the ears of the developer on the sleeve were dense, and good images were obtained both in the initial stage and after the blank rotation, but carrier adhesion occurred.

COMPARATIVE EXAMPLE 9

$Fe_2O_3$, ZnO and CuO were weighed in proportions of 60 mol %, 23 mol % and 17 mol %, respectively, and blended in a ball mill. The blended material was calcined, pulverized and made into a slurry, which was then formed into particles and then calcined. The calcined particles were classified by a pneumatic classifier to obtain carrier core particles having an average particle size of 47 μm. The core particles were almost spherical and showed a resistivity of $6.7\times10^{9}$ ohm.cm.

The core particles were surface-coated with the same resin in the same manner as in Example 12. The properties of the coated carrier are shown in Table 5.

The coated carrier was subjected to evaluation in the same manner as in Example 12. As a result, no carrier adhesion was caused in the initial stage. However, the ears of the developer on the developing sleeve were sparse and halftone images after 40 min. of the blank rotation were coarse and accompanied with disturbance of lines.

EXAMPLE 13

| | |
|---|---|
| Styrene/isobutyl acrylate (80/20) copolymer | 26 wt. parts |
| Ba ferrite fine powder (plate like) $Fe_2O_3$/ZnO/BaO = 70/15/15 by mol | 30 wt. parts |

-continued

| | |
|---|---|
| Cu—Zn ferrite ($Fe_2O_3$/CuO/ZnO = 60/20/20 by mol) | 44 wt. parts |

The above materials were melt kneaded and extruded in a magnetic field for orientation of magnetic particles in the binder resin and, after cooling, pulverized and classified in the same manner as in Example 12, followed further by sphering, to obtain magnetic material-dispersed resin particles (core particles), which showed a resistivity of $2.4\times10^{10}$ ohm.cm.

The core particles were coated with the same resin in the same manner as in Example 12. The coated carrier showed an orientation degree of 60% as a result of sectional observation through an FE-SEM. The properties of the coated carrier are shown in Table 5. The coated carrier was evaluated in the same manner as in Example 12, whereby good images were obtained with no carrier adhesion similarly as in Example 12.

COMPARATIVE EXAMPLE 10

| | |
|---|---|
| Styrene/butyl acrylate (80/20) copolymer | 30 wt. parts |
| Ba ferrite ($F_2O_3$/BaO/ZnO = 70/20/10 (mol)) | 70 wt. parts |

The above materials were melt-kneaded without orientation to obtain magnetic material-dispersed carrier core particles.

The core particles showed a particle size of 52 μm and a resistivity of $5.3\times10^{10}$ ohm.cm. The core particles were surface-coated with the same resin in the same manner as in Example 12. The properties of the coated carrier are shown in Table 5.

The coated carrier was subjected to evaluation in the same manner as in Example 12. As a result, the ears on the sleeve was dense and no carrier adhesion was observed. However, it was difficult to take in the developer under stirring, thus failing to provide high-quality images. Images became inferior after the blank rotation.

EXAMPLE 14

80 parts of styrene monomer, 20 parts of isobutyl acrylate and 257 parts of 3% Zn-doped $\gamma$-$Fe_2O_3$ fine powder (horizontal diameter: D1=1.0 μm, Ds=0.15 μm) were placed in a vessel, heated therein to 70° C. and held at 70° C., and azobisisobutyronitrile (polymerization initiator) was added thereto to form a polymerizable mixture, which was then charged into a 2 liter-flask containing 1.2 liter of 1% PVA (polyvinyl alcohol) aqueous solution and stirred by a homogenizer in a magnetic field at 70° C. for 10 min. to form the mixture in the form of particles. Then, while being stirred by a paddle stirrer, the content was subjected to suspension polymerizer at 70° C. for 10 hours. After the polymerization, the product was cooled, recovered, washed, filtered and dried to obtain magnetic material-dispersed resinous carrier core particles. The core particles showed an average particle size of 51 μm and a resistivity of $1.3\times10^{10}$ ohm.cm.

The core particles were coated with the same resin in the same manner as in Example 12. The coated carrier was evaluated in the same manner as in Example 12, whereby good results were obtained.

EXAMPLE 15

| | |
|---|---|
| Phenol | 10 wt. parts |
| Formalin (formaldehyde = ca. 37%, methanol = ca. 5%, the remainder: water) | 5 wt. parts |
| Magnetic Sr ferrite ($Fe_2O_3$/SrO/CaO = 80/17/3 by mol) | 23 wt. parts |
| Magnetic Cu—Zn ferrite ($Fe_2O_3$/CuO/ZnO = 60/15/25 by mol) | 62 wt. parts |

The above materials were stirred in an aqueous phase containing ammonia (basic catalyst) and calcium fluoride (polymerization stabilizer), gradually heated to 80° C. and subjected to 2 hours of polymerization in a magnetic field. After filtration and washing, the resultant polymerizate particles were classified to obtain magnetic material-dispersed resin particles (core particles).

The core particles showed a particle size of 46 μm, a resistivity of $2.0\times10^{9}$ ohm.cm, and an orientation degree of 52%, and were coated with the same resin in the same manner as in Example 12, whereby a good coating state was obtained. The properties of the coated carrier are shown in Table 5. The coated carrier was evaluated in the same manner as in Example 12, whereby good images were obtained without causing carrier adhesion.

EXAMPLE 16

Carrier core particles were prepared by polymerization in the same manner as in Example 15 except that 70 wt. % of $\gamma$-$Fe_2O_3$ was used as the magnetic material together with the remainder of the resin precursor. The resultant core particles showed a particle size of 50 μm, a resistivity of $9.2\times10^{5}$ ohm.cm, and an orientation degree of 96%, and were coated with the same resin in the same manner as in Example 12, whereby a good coating state similarly as in Example 15 was obtained. The properties of the coated carrier are shown in Table 5. The coated carrier was evaluated in the same manner as in Example 12, whereby good images were obtained in the successive image forming test without causing carrier adhesion.

EXAMPLE 17

| | |
|---|---|
| Styrene-acrylic resin | 100 wt. parts |
| Carbon black | 6 wt. parts |
| Di-tert-butylsalicylic acid chromium complex salt | 4 wt. parts |

From the above materials, a toner having a weight-average particle size of 8.3 μm was prepared in the same manner as in Example 12.

100 wt. parts of the toner was blended with 0.7 wt. part of silica fine powder treated with hexamethyldisilazane for hydrophobicity treatment by a Henschel mixer to form a black toner carrying silica fine powder attached to the surface thereof.

The carrier core particles of Example 12 were used as they were without being further coated and, after being magnetized in a magnetic field of 10 kilo-oersted, were blended with the above black toner to obtain a two-component developer having a toner concentration of 5 wt. %. The developer was evaluated in the same manner as in Example 12, whereby good images were obtained with no carrier adhesion both in the initial stage and after the blank rotation similarly as in Example 12.

TABLE 5

| Example No. | Size (μm) | Bulk density (g/cm³) | Magnetic material | Hc (oe) | $\sigma_{1000}$ (emu/cm³) | $\sigma_{300}$ (emu/cm³) | $\sigma_r$ (emu/cm³) | $\frac{\lvert\sigma_{1000}-\sigma_{300}\rvert}{\sigma_{1000}}$ | Resistivity (Ω · cm) | Orientation (%) | Sphericity |
|---|---|---|---|---|---|---|---|---|---|---|---|
| Ex. 12 | 1.64 | 48 | needle $\gamma$-$Fe_2O_3$ 3% Zn dope | 168 | 69 | 63 | 50 | 0.09 | $6.7 \times 10^{13}$ | 55 | 1.28 |
| Comp. Ex. 8 | 1.65 | 46 | Cu—Zn ferrite | 3 | 65 | 25 | 2 | 0.61 | $3.4 \times 10^{13}$ | — | 1.30 |
| Comp. Ex. 9 | 2.43 | 49 | Cu—Zn ferrite carrier | 3 | 203 | 110 | 1 | 0.46 | $2.3 \times 10^{13}$ | — | 1.32 |
| Ex. 13 | 1.67 | 50 | Ba ferrite Cu—Zn ferrite | 230 | 93 | 86 | 58 | 0.08 | $2.4 \times 10^{12}$ | 60 | 1.33 |
| Comp. Ex. 10 | 1.66 | 52 | Ba ferrite | 1650 | 110 | 92 | 81 | 0.16 | $4.6 \times 10^{13}$ | 16 | — |
| Ex. 14 | 1.63 | 51 | Same as in Ex. 12 | 170 | 73 | 68 | 57 | 0.07 | $6.9 \times 10^{13}$ | 62 | 1.05 |
| Ex. 15 | 1.92 | 46 | Sr ferrite Cu—Zn ferrite | 200 | 97 | 91 | 78 | 0.06 | $2.8 \times 10^{12}$ | 52 | 1.04 |
| Ex. 16 | 1.64 | 50 | $\gamma$-$Fe_2O_3$ | 250 | 78 | 74 | 66 | 0.05 | $5.3 \times 10^{13}$ | 63 | 1.04 |
| Ex. 17 | 1.64 | 48 | needle $\gamma$-$Fe_2O_3$ 3% Zn dope | 168 | 69 | 63 | 50 | 0.09 | $2.2 \times 10^{10}$ | 55 | 1.28 |

TABLE 6

| | Initial images | | | | Images after 40 min. of blank rotation | | | |
|---|---|---|---|---|---|---|---|---|
| | Solid part uniformity | Halftone reproducibility | Line reproducibility | Carrier adhesion | Solid part uniformity | Halftone reproducibility | Line reproducibility | Carrier adhesion |
| Ex. 12 | ◎ | ◎ | ◎ | ◎ | ◎ | ◎ | ◎ | ◎ |
| Comp. Ex. 8 | ◎ | ◎ | ◎ | X | ◎ | ◎ | ◎ | X |
| Comp. Ex. 9 | ○ | ○ | ○ | ○ | X | Δ | X | ○ |
| Ex. 13 | ◎ | ◎ | ◎ | ◎ | ◎ | ◎ | ◎ | ◎ |
| Comp. Ex. 10 | Δ | Δ | Δ | ○ | — | — | — | — |
| Ex. 14 | ◎ | ◎ | ◎ | ◎ | ◎ | ◎ | ◎ | ◎ |
| Ex. 15 | ◎ | ◎ | ◎ | ◎ | ○ | ◎ | ◎ | ◎ |
| Ex. 16 | ◎ | ◎ | ◎ | ◎ | ◎ | ◎ | ◎ | ◎ |
| Ex. 17 | ○ | ◎ | ◎ | ○ | ○ | ◎ | ◎ | ○ |

◎: Excellent, ○: Good, Δ: Fair, X: Poor

EXAMPLE 18

A slurry was prepared by adding polyvinyl alcohol, an anti-foaming agent and a dispersant to 8% Zn-doped needle-like $\gamma$-$Fe_2O_3$ (Dl=0.8 μm, Ds=0.12 μm) and subjected to magnetization in a magnetic field of 10 kilo-oersted by an electro-magnet. Then, the slurry was formed into particles in a magnetic field, followed by drying, sintering and classification to obtain carrier core particles having an average particle size of 47 μm, which were almost spherical.

As a result of observation through an FE-SEM, the core particles showed an orientation degree of crystal particles of 52%. Further, the core particles showed a bulk density of 2.11 g/cm³ and a resistivity of $5.2\times10^8$ ohm.cm. After being magnetically saturated in a magnetic field of 10 kilo-oersted, the core particles showed magnetic properties of $\sigma_{1000}$=98 emu/cm³, $\sigma_r$=87 emu/cm³, $\sigma_{300}$=92 emu/cm³, Hc=240 oersted, and $(\sigma_{1000}-\sigma_{300})/\sigma_{1000}$=0.06.

The core particles were then coated with about 0.8 wt. % of styrene/2-ethylhexyl methacrylate. (50/50) copolymer by fluidized bed coating. The resin-coated carrier showed a resistivity of $8.3\times10^{12}$ Ω.cm and magnetic properties substantially identical to those of the core particles before coating.

A cyan toner was prepared from the following materials.

| | |
|---|---|
| Polyester resin formed by condensation between propoxidized bisphenol and fumaric acid | 100 wt. parts |
| Phthalocyanine pigment | 5 wt. parts |
| Di-tert-butylsalicylic acid chromium complex salt | 4 wt. parts |

The above materials were preliminarily blended sufficiently, melt-kneaded and, after cooling, coarsely crushed into particles of about 1–2 μm, followed further by fine pulverization by an air jet pulverizer and classification to obtain a negatively chargeable cyan-colored powder (cyan toner) having a weight-average particle size of 8.4 μm.

100 wt. parts of the cyan toner was blended with 0.8 wt. part of silica fine powder treated with hexamethyldisilazane for hydrophobicity treatment to prepare a cyan toner carrying silica fine powder attached to the surface thereof.

The above coated carrier was magnetized (magnetically saturated) in a magnetic field of 10 kilo-oersted for magnetization and blended with the cyan toner to obtain a two-component developer having a toner content of 5 wt. %. The developer was charged in a remodeled commercially available full-color laser copying machine ("CLC-500", mfd. by Canon K.K.) and used for image formation. FIG. 6 schematically illustrates the developing device and the photosensitive drum around the developing zone in the remodeled copying machine. The gap between the developing sleeve and the developer regulating member was 400 μm, and the developing sleeve and the photosensitive member were rotated at a peripheral speed ratio of 1.3:1 with a peripheral speed of 300 mm/sec for the developing sleeve. The developing conditions included a developing pole magnetic field strength of 1000 oersted, an alternating electric field of 2000 Vpp, a frequency of 3000 Hz, and a spacing of 500 μm between the sleeve and the photosensitive drum. As a result of microscopic observation, the magnetic brush ears near the magnetic pole were dense and short, and the magnetic brush on the sleeve contacted the photosensitive drum at the developing station.

The resultant images showed a sufficient density at a solid image part, were free from coarse images and showed particularly good reproducibility of halftone parts and line images. No toner adhesion was observed either at the image parts or the non-image parts. After 40 minutes of blank rotation of the developing sleeve at 200 rpm, image formation was again performed, whereby very good images were obtained with no problem at all regarding image qualities and no carrier adhesion.

EXAMPLE 19

Carrier core particles having an average particle size of 51 μm were prepared in the same manner as in Example 18 except for using needle-like $\gamma$-$Fe_2O_3$ doped with 10% of Zn and 5% of Mg (D1=0.53 μm, Ds=0.14 μm).

The resultant carrier core particles were almost spherical and showed a bulk density of 2.04 g/cm$^3$ a resistivity of $7.4\times10^9$ Ω.cm and an orientation degree of 56%. After being magnetically saturated in a magnetic field of 10 kilo-oersted, the carrier core showed magnetic properties of $\sigma_{1000}$=54 emu/cm$^3$, $\sigma_r$46 emu/cm$^3$, $\sigma_{300}$51 emu/cm$^3$, Hc=180 oersted, and $(\sigma_{1000}-\sigma_{300})/\sigma_{1000}$=0.06.

The thus-obtained carrier core was surface coated with a resin in the same manner as in Example 18. The resin-coated carrier showed a resistivity of $4.8\times10^{12}$ ohm.cm and the magnetic properties thereof were substantially identical to those of the carrier core.

The coated carrier was then magnetized in the same manner as in Example 18 and blended with the same toner as in Example 18 to obtain a two-component developer. The developer was used for image formation in the same manner as in Example 18. As a result, the magnetic brush on the developing sleeve was dense, and good images were formed free from coarseness at halftone parts and with good reproducibility of thin line parts. Further, in spite of the small $\sigma_{1000}$ value, no carrier adhesion was observed at either the image part or the non-image part. Images formed after the blank rotation showed a sufficient density at a solid part, a good halftone part free from coarseness and no carrier adhesion.

COMPARATIVE EXAMPLE 11

The needle-like $\gamma$-$Fe_2O_3$ used in Example 19 was formed into particles without orientation otherwise in the same manner as in Example 18 to obtain carrier core particles having an average particle size of 52 μm. The core particles were almost spherical. The core particles showed an orientation degree of 13%, a bulk density of 2.02 g/cm$^3$ and a resistivity of $1.1\times10^9$ Ω.cm. The carrier core showed magnetic properties of $\sigma_{1000}$=52 emu/cm$^3$, $\sigma_r$=14 emu/cm$^3$, $\sigma_{300}$29 emu/cm$^3$, Hc=160 oersted and $(\sigma_{1000}-\sigma_{300})/\sigma_{1000}$=0.44.

The carrier core was surface-coated with a resin in the same manner as in Example 18. The coated carrier showed a resistivity of $1.5\times10^{12}$ ohm.cm. The coated carrier was then magnetically saturated in the same manner as in Example 18 and blended with the same toner as in Example 18 to obtain a two-component developer.

The developer was used for image formation in the same manner as in Example 18. As a result, the magnetic brush on the developing sleeve was dense, and the result images showed halftone parts free from coarseness and very excellent reproducibility of thin lines, but slight carrier adhesion was observed at non-image parts, and correspondingly toner fog was observed at the non-image parts.

COMPARATIVE EXAMPLE 12

$Fe_2O_3$ and $SrCO_3$ were weighed in a molar ratio of 85 mol % and 15 mol %, respectively and blended in a ball mill. The blend powder was calcined, pulverized and made into a slurry, which was then formed into particles and then sintered. The sintered particles were classified by a pneumatic classifier to obtain carrier core particles having an average particle size of 59 μm. The core particles were almost spherical and showed an orientation degree of crystal particles of 12%. The core particles showed a bulk density of 2.01 g/cm$^3$ and a resistivity of $9.5\times10^8$ Ω.cm. After being magnetically saturated in a magnetic field of 10 kilo-oersted, the carrier showed magnetic properties of $\sigma_{1000}$=101 emu/cm$^3$, $\sigma_r$76 emu/cm$^3$, $\sigma_{300}$=89 emu/cm$^3$, Hc=2040 oersted, and $(\sigma_{1000}-\sigma_{300})/\sigma_{1000}$=0.12.

The thus-obtained carrier core was surface-coated with a resin in the same manner as in Example 18. The coated carrier showed a resistivity of $3.5\times10^{12}$ ohm.cm. The coated carrier was then magnetically saturated in the same manner as in Example 18 and blended with the same toner as in Example 18 to obtain a two-component developer.

The developer was used for image formation in the same manner as in Example 18, whereby the developer showed a poor fluidity on the developing sleeve because of the self-agglomeratability of the carrier, thus failing to effect mixing with the toner and conveyance of the developer in a satisfactory manner.

COMPARATIVE EXAMPLE 13

$Fe_2O_3$, ZnO and CuO were weighed in molar proportions of 62 mol %, ZnO 16 mol % and 22 mol %, respectively, and blended in a ball mill. From the blended material, carrier core particles having an average particle size of 50 μm were obtained in the same manner as in Comparative Example 12. The core particles were almost spherical. The core particles showed a bulk density of 2.77 g/cm$^3$ and a resistivity of $4.0\times10^9$ Ω.cm. After being magnetically saturated in a magnetic field of 10 kilo-oersted, the carrier core showed magnetic properties of $\sigma_{1000}$=214 emu/cm$^3$, $\sigma_r$=2 emu/cm$^3$, $\sigma_{300}$113 emu/cm$^3$, Hc=10 oersted, and $(\sigma_{1000}-\sigma_{300})/\sigma_{1000}$=0.47.

The thus-obtained carrier core was surface-coated with a resin in the same manner as in Example 18. The coated carrier showed a resistivity of $3.2\times10^{12}$ ohm.cm. The coated carrier was blended with the same toner as in Example 18 to obtain a two-component developer.

The developer was used for image formation in the same manner as in Example 18, whereby the developer showed a good fluidity on the developing sleeve and good conveyability. However, the magnetic brush in the vicinity of the magnetic pole was observed to be sparse, thus resulting in coarseness at halftone parts. After blank rotation in the same manner as in Example 18, coarseness was observed particularly at the halftone parts.

EXAMPLE 20

Magnetic materials of $BaO_{0.10}$—$ZnO_{0.13}$—$(Fe_2O_3)_{0.77}$ and $CuO_{0.15}$—$ZnO_{0.25}$—$(Fe_2O_3)_{0.60}$, respectively in a particle size of about 0.5 μm were blended in a ratio of 1:1 and formed into particles in a magnetic field in the same manner as in Example 18, followed by sintering to obtain carrier particles, which were then classified by a pneumatic classifier to obtain carrier core particles having an average particle size of 44 μm. The resultant core particles were almost spherical and showed an orientation degree of 46%. The core particles showed a bulk density of 2.21 g/cm$^3$ and a resistivity of $2.5\times10^9$ ohm.cm. The carrier core showed magnetic properties of $\sigma_{1000}$=84 emu/cm$^2$, $\sigma_r$=55 emu/cm$^3$, $\sigma_{300}$73 emu/cm$^3$, Hc=250 oersted, and $(\sigma_{1000}-\sigma_{300})/\sigma_{1000}$= 0.13.

The thus-obtained carrier core was surface-coated with a resin in the same manner as in Example 18. The coated carrier showed a resistivity of $8.5\times10^{12}$ ohm.cm.

The coated carrier was then magnetized in the same manner as in Example 18 and blended with the same toner as in Example 18 to obtain a two-component developer. The developer was used for image formation in the same manner as in Example 18. As a result, the magnetic brush on the developing sleeve was dense, and the resultant images were particularly free from coarseness at halftone parts and very excellent in reproducibility of thin lines. No carrier adhesion was observed at either the image parts or the nonimage parts and thus high-quality images were produced. Images formed after the blank rotation were identical to those at the initial stage and free from carrier adhesion.

EXAMPLE 21

A two-component developer was prepared by mixing the coated carrier used in Example 18 and a toner prepared in the following manner.

Styrene-acrylic resin 100 wt. parts

| | |
|---|---|
| Styrene-acrylic resin | 100 wt. parts |
| Carbon black | 5 wt. parts |
| Di-tert-butylsalicylic acid chromium complex salt | 4 wt. parts |

From the above materials, a toner having a weight-average particle size of 7.3 μm was prepared in the same manner as in Example 18.

100 wt. parts of the toner was blended with 1.0 wt. parts of silica fine powder treated with hexamethyldisilazane for hydrophobicity treatment by a Henschel mixer to form a black toner carrying silica fine powder attached to the surface thereof.

The toner and the coated carrier used in Example 18 were blended with each other to obtain a two-component developer having a toner concentration of 5%. The developer was used for image formation in the same manner as in Example 18.

The resultant images showed a sufficient density at solid image parts, were free from coarseness and showed uniform reproducibility of halftone parts and particularly good reproducibility of line images. Further, no carrier adhesion was observed either at images parts or non-image parts. The results of image formation after the blank rotation were also good.

The physical properties of the carriers prepared above are shown in Table 7 and the evaluation results thereof are shown in Table 8 wherein the respective marks indicate the following levels of performances:

⊙: very good, ○: good,

Δ: fair, X: not acceptable.

TABLE 7

| Example No. | Size (μm) | Bulk density (g/cm$^3$) | Magnetic material | Hc (oe) | $\sigma_{1000}$ (emu/cm$^3$) | $\sigma_{300}$ (emu/cm$^3$) | $\sigma_r$ (emu/cm$^3$) | $\frac{\lvert\sigma_{1000}-\sigma_{300}\rvert}{\sigma_{1000}}$ | Resistivity (Ω · cm) | Orientation (%) | Sphericity |
|---|---|---|---|---|---|---|---|---|---|---|---|
| Ex. 18 | 47 | 2.11 | γ-$Fe_2O_3$ (Zn dope) | 240 | 98 | 90 | 84 | 0.08 | $8.3\times10^{12}$ | 52 | 1.11 |
| Ex. 19 | 51 | 2.04 | γ-$Fe_2O_3$ (Zn, Mn dope) | 180 | 54 | 51 | 46 | 0.06 | $4.8\times10^{12}$ | 56 | 1.15 |
| Comp. Ex. 11 | 52 | 2.02 | Same as in Ex. 19 | 160 | 52 | 29 | 14 | 0.44 | $1.5\times10^{12}$ | 13 | 1.13 |
| Comp. Ex. 12 | 59 | 2.01 | Sr ferrite | 2040 | 101 | 89 | 76 | 0.12 | $3.5\times10^{12}$ | 12 | 1.20 |
| Comp. Ex. 13 | 50 | 2.77 | Cu—Zn ferrite | 10 | 214 | 113 | 2 | 0.47 | $3.2\times10^{12}$ | — | 1.06 |
| Ex. 20 | 44 | 2.21 | Ba ferrite Cu—Zn ferrite | 250 | 84 | 73 | 55 | 0.13 | $2.0\times10^{12}$ | 46 | 1.10 |

TABLE 8

| Example No. | Developer fluidity | Initial images: Solid part density | Initial images: Solid part uniformity | Initial images: Halftone reproducibility | Initial images: Line reproducibility | Initial images: Carrier adhesion | Images after 30 in. of blank rotation: Solid part density | Images after 30 in. of blank rotation: Solid part uniformity | Images after 30 in. of blank rotation: Halftone reproducibility | Images after 30 in. of blank rotation: Line reproducibility | Images after 30 in. of blank rotation: Carrier adhesion |
|---|---|---|---|---|---|---|---|---|---|---|---|
| Ex. 18 | ○ | ⊙ | ⊙ | ⊙ | ⊙ | ⊙ | ⊙ | ○ | ○ | ○ | ⊙ |
| Ex. 19 | ○ | ⊙ | ⊙ | ⊙ | ⊙ | ○ | ⊙ | ⊙ | ⊙ | ⊙ | ○ |
| Comp. Ex. 11 | ○ | ⊙ | ⊙ | ⊙ | ⊙ | X | ⊙ | ⊙ | ⊙ | ⊙ | X |
| Comp. Ex. 12 | X | | | — | | | | | — | | |
| Comp. Ex. 13 | ⊙ | ○ | Δ | Δ | ○ | ⊙ | ○ | X | X | Δ | ⊙ |
| Ex. 20 | ○ | ⊙ | ⊙ | ⊙ | ⊙ | ⊙ | ⊙ | ○ | ○ | ○ | ⊙ |
| Ex. 21 | ○ | ⊙ | ⊙ | ⊙ | ⊙ | ⊙ | ⊙ | ○ | ○ | ○ | ⊙ |

⊙: Excellent, ○: Good, Δ: Fair, X: Poor

What is claimed is:

1. A carrier for use in electrophotography, comprising carrier particles each comprising a binder resin and magnetic fine particles dispersed within the binder resin in an amount of 30–99 wt. %, said carrier particles having an average particle size of 5–100 μm, wherein said carrier has a bulk density of at most 3.0 g/cm$^3$, and magnetic properties measured in a tightly packed state including: a magnetization of 30–150 emu/cm$^3$ under a magnetic field strength of 1000 oersted, a magnetization (residual magnetization $\sigma_r$) of at least 25 emu/cm$^3$ under a magnetic field strength of zero oersted, a coercive force of less than 300 oersted and a relationship of:

$$|\sigma_{1000}-\sigma_{300}|/\sigma_{1000} \leqq 0.40$$

wherein $\sigma_{1000}$ and $\sigma_{300}$ denote magnetizations under magnetic field strength of 1000 oersted and 300 oersted, respectively.

2. The carrier according to claim 1, wherein said carrier particles comprise a ferrite containing: Fe and O as essential elements; at least one species of a third element selected from the group consisting of Li, Be, B, C, N, Na, Mg, Al, Si, P, S, K, Ca, Ti, V, Cr, Mn, Co, Ni, Cu, Zn, Ga, Ge, As, Se Rb, Sr, Zr, Nb, Mo, Tc, Ru, Rh, Pd, Ag, Cd, In, Sn, Sb, Te, Cs, Ba, Hf, Ta, W, Re, Os, Ir, Pt, Au, Tl, Pb and Bi, and less than 1 wt. %, if any, of a fourth element different from Fe, O and the third element based on the ferrite.

3. The carrier according to claim 1, wherein said carrier particles have a single phase having a spinel structure, a single phase having a magnetoplumbite structure, a complex phase having at least a spinel structure or a magnetoplumbite structure, or a complex phase having a spinel structure and a magnetoplumbite structure.

4. The carrier according to claim 1, wherein said carrier particles have a spinel structure phase and a magnetoplumbite structure phase at a molar ratio of 1:1 to 10:1.

5. The carrier according to claim 1, wherein said carrier particles have a resistivity of $10^8$–$10^{13}$ ohm.cm.

6. The carrier according to claim 1, wherein said carrier particles are coated with a resin.

7. The carrier according to claim 1, wherein said carrier particles have a magnetization of 30–120 emu/cm$^3$ under a magnetic field strength of 1000 oersted.

8. The carrier according to claim 1, wherein said carrier particles have an average particle size of 20–60 μm.

9. The carrier according to claim 1, wherein said carrier particles have a sphericity of at most 2.

10. The carrier according to claim 1, wherein said carrier particles have a value of $|\sigma_{1000}-\sigma_{300}|/\sigma_{1000}$ is at most 0.30.

11. The carrier according to claim 10, wherein said carrier particles are coated with a resin.

12. The carrier according to claim 1, wherein said magnetic fine particles have a primary average particle size of at most 2.0 μm.

13. The carrier according to claim 1, wherein the magnetic particles having a ratio of longer axis/shorter axis of more than 1, at least 30 wt. % of the magnetic fine particles being oriented within a range of ±15° from an assumed direction of an applied magnetic field.

14. The carrier according to claim 13, wherein said magnetic fine particles have a primary average particle size of at most 1 μm.

15. The carrier according to claim 13, wherein said carrier particles are coated with a resin.

16. The carrier according to claim 1, wherein said carrier particles comprise crystalline magnetic particles in the form of a plate or a needle, at least 30 wt. % of the magnetic particles being oriented within a range of ±15 degrees from an assumed direction of an applied magnetic field, the magnetic particles showing a shape anisotropy in a uniaxial direction and having a ratio of longer axis/shorter axis of more than 1.

17. The carrier according to claim 1, wherein the magnetic properties of the carrier include a magnetization of 30–103 emu/cm$^3$ under a magnetic field of 1,000 oersted and a coercive force of at most 240 oersted.

18. A two component developer for developing an electrostatic image, comprising a toner and a carrier, said carrier comprising carrier particles each comprising a binder resin and magnetic fine particles dispersed within the binder resin in an amount of 30–99 wt. %, said carrier particles having an average particle size of 5–100 μm, wherein said carrier has a bulk density of at most 3.0 g/cm$^3$, and magnetic properties measured in a tightly packed state including: a magnetization of 30–150 emu/cm$^3$ under a magnetic field strength of 1000 oersted, a magnetization (residual magnetization $\sigma_r$) of at least 25 emu/cm$^3$ under a magnetic field strength of zero oersted, a coercive force of less than 300 oersted and a relationship of:

$$|\sigma_{1000}-\sigma_{300}|/\sigma_{1000} \leqq 0.40$$

wherein $\sigma_{1000}$ and $\sigma_{300}$ denote magnetizations under magnetic field strength of 1000 oersted and 300 oersted, respectively.

19. The developer according to claim 18, wherein said toner is contained at 0.5–20 wt. % based on the developer.

20. The developer according to claim 18, wherein said toner is contained at 1–10 wt. % based on the developer.

21. The developer according to claim 18, wherein said toner has an agglomeration degree of at most 30%.

22. The developer according to claim 18, wherein said toner has a weight-average particle size of 1–20 μm.

23. The developer according to claim 18, wherein said toner has a weight-average particle size of 4–10 μm.

24. The developer according to claim 18, wherein said carrier particles comprise a ferrite containing: Fe and O as essential elements; at least one species of a third element selected from the group consisting of Li, Be, B, C, N, Na, Mg, Al, Si, P, S, K, Ca, Ti, V, Cr, Mn, Co, Ni, Cu, Zn, Ga, Ge, As, Se Rb, Sr, Zr, Nb, Mo, Tc, Ru, Rh, Pd, Ag, Cd, In, Sn, Sb, Te, Cs, Ba, Hf, Ta, W, Re, Os, Ir, Pt, Au, Tl, Pb and Bi, and less than 1 wt. %, if any, of a fourth element different from Fe, O and the third element based on the ferrite.

25. The developer according to claim 18, wherein said carrier particles have a single phase having a spinel structure, a single phase having a magnetoplumbite structure, a complex phase having at least a spinel structure or a magnetoplumbite structure, or a complex phase having a spinel structure and a magnetoplumbite structure.

26. The developer according to claim 18, wherein said carrier particles have a spinel structure phase and a magnetoplumbite structure phase at a molar ratio of 1:1 to 10:1.

27. The developer according to claim 18, wherein said carrier particles have a resistivity of $10^8$–$10^{13}$ ohm.cm.

28. The developer according to claim 18, wherein said carrier particles are coated with a resin.

29. The developer according to claim 18, wherein said carrier particles have a magnetization of 30–120 emu/cm$^3$ under a magnetic field strength of 1000 oersted.

30. The developer according to claim 18, wherein said carrier particles have an average particle size of 20–60 μm.

31. The developer according to claim 18, wherein said carrier particles have a sphericity of at most 2.

32. The developer according to claim 18, wherein said carrier particles have a value of $|\sigma_{1000}-\sigma_{300}|\sigma_{1000}$ is at most 0.30.

33. The developer according to claim 32, wherein said carrier particles are coated with a resin.

34. The developer according to claim 18, wherein said magnetic fine particles have a primary average particle size of at most 2.0 μm.

35. The developer according to claim 18, wherein the magnetic particles having a ratio of longer axis/shorter axis of more than 1, at least 30 wt. % of the magnetic fine particles being oriented within a range of ±15° from an assumed direction of an applied magnetic field.

36. The developer according to claim 35, wherein said magnetic fine particles have a primary average particle size of at most 1 μm.

37. The developer according to claim 35, wherein said carrier particles are coated with a resin.

38. The developer according to claim 18, wherein said carrier particles comprise crystalline magnetic particles in the form of a plate or a needle, at least 30 wt. % of the magnetic particles being oriented within a range of ±15 degrees from an assumed direction of an applied magnetic field, the magnetic particles showing a shape anisotropy in a uniaxial direction and having a ratio of longer axis/shorter axis of more than 1.

39. The developer according to claim 18, wherein the magnetic properties of the carrier include a magnetization of 30–103 emu/cm$^3$ under a magnetic field of 1,000 oersted and a coercive force of at most 240 oersted.

40. An image forming method, comprising:

conveying a two component developer comprising a toner and a magnetic carrier carried on a developer-carrying member to a developing station, and forming a magnetic brush of the developer in a magnetic field formed by a developing magnetic pole disposed inside the developer carrying member at the developing station and causing the magnetic brush to contact an electrostatic latent image held on a latent image-bearing member, thereby developing the electrostatic latent image to form a toner image;

wherein said carrier comprises carrier particles each comprising a binder resin and magnetic fine particles dispersed within the binder resin in an amount of 30–99 wt. %, said carrier particles having an average particle size of 5–100 μm, and said carrier has a bulk density of at most 3.0 g/cm$^3$ and magnetic properties measured in a tightly packed state including: a magnetization of 30–150 emu/cm$^3$ under a magnetic field strength of 1000 oersted, a magnetization (residual magnetization $\sigma_r$) of at least 25 emu/cm$^3$ under a magnetic field strength of zero oersted, a coercive force of less than 300 oersted and a relationship of:

$$|\sigma_{1000}-\sigma_{300}|/\sigma_{1000}\leqq 0.40$$

wherein $\sigma_{1000}$ and $\sigma_{300}$ denote magnetizations under magnetic field strength of 1000 oersted and 300 oersted, respectively.

41. The image forming method according to claim 40, wherein said magnet is fixed.

42. The image forming method according to claim 40, wherein said electrostatic latent image is developed with the magnetic brush on the developer-carrying member under application of an alternating bias voltage.

43. The image forming method according to claim 40, wherein said carrier particles comprise a ferrite containing: Fe and O as essential elements; at least one species of a third element selected from the group consisting of Li, Be, B, C, N, Na, Mg, Al, Si, P, S, K, Ca, Ti, V, Cr, Mn, Co, Ni, Cu, Zn, Ga, Ge, As, Se Rb, Sr, Zr, Nb, Mo, Tc, Ru, Rh, Pd, Ag, Cd, In, Sn, Sb, Te, Cs, Ba, Hf, Ta, W, Re, Os, Ir, Pt, Au, Tl, Pb and Bi, and less than 1 wt. %, if any, of a fourth element different from Fe, O and the third element based on the ferrite.

44. The image forming method according to claim 40, wherein said carrier particles have a single phase having a spinel structure, a single phase having a magnetoplumbite structure, a complex phase having at least a spinel structure or a magnetoplumbite structure, or a complex phase having a spinel structure and a magnetoplumbite structure.

45. The image forming method according to claim 40, wherein said carrier particles have a spinel structure phase and a magnetoplumbite structure phase at a molar ratio of 1:1 to 10:1.

46. The image forming method according to claim 40, wherein said carrier particles have a resistivity of $10^8$–$10^{13}$ ohm.cm.

47. The image forming method according to claim 40, wherein said carrier particles are coated with a resin.

48. The image forming method according to claim 40, wherein said carrier particles have a magnetization of 30–120 emu/cm$^3$ under a magnetic field strength of 1000 oersted.

49. The image forming method according to claim 40, wherein said carrier particles have an average particle size of 20–60 μm.

50. The image forming method according to claim 40, wherein said carrier particles have a sphericity of at most 2.

51. The image forming method according to claim 40, wherein said carrier particles have a value of $|\sigma_{1000}-\sigma_{300}|/\sigma_{1000}$ is at most 0.30.

52. The image forming method according to claim 51, wherein said carrier particles are coated with a resin.

53. The image forming method according to claim 40, wherein said magnetic fine particles have a primary average particle size of at most 2.0 μm.

54. The image forming method according to claim 40, wherein the magnetic particles having a ratio of longer axis/shorter axis of more than 1, at least 30 wt. % of the magnetic fine particles being oriented within a range of ±15° from an assumed direction of an applied magnetic field.

55. The image forming method according to claim 54, wherein said magnetic fine particles have a primary average particle size of at most 1 μm.

56. The image forming method according to claim 57, wherein said carrier particles are coated with a resin.

57. The image forming method according to claim 40, wherein said carrier particles comprise crystalline magnetic particles in the form of a plate or a needle, at least 30 wt. % of the magnetic particles oriented within a range of ±15 degrees from an assumed direction of an applied magnetic field, the magnetic particles showing a shape anisotropy in a uniaxial direction and having a ratio of longer axis/shorter axis of more than 1.

58. The image forming method according to claim 40, wherein the magnetic properties of the carrier include a magnetization of 30–103 emu/cm$^3$ under a magnetic field of 1,000 oersted and a coercive force of at most 240 oersted.

* * * * *

UNITED STATES PATENT AND TRADEMARK OFFICE

CERTIFICATE OF CORRECTION

PATENT NO. : 5,576,133

DATED : November 19, 1996

INVENTOR(S) : YOSHINOBU BABA ET AL.

It is certified that error appears in the above-identified patent and that said Letters Patent is hereby corrected as shown below:

COLUMN 1

Line 57, "of," should read --,--.

COLUMN 2

Line 13, "59-104863." should read --59-104663.--.
Line 19, "leaves" should read --is conducted--.
Line 23, "lard" should read --hard-.
Line 41, "used," should read --used--.
Line 51, "electrophtography" should read --electrophotography--.
Line 60, "electrophtography" should read --electrophotography--.

COLUMN 3

Line 19, "3.0 g/cm$^3$" should read --3.0 g/cm$^3$,--.
Line 36, "3.0 g/cm$^{TM}$" should read --3.0 g/cm$^3$,--.
Line 62, "an" should read --and--.

COLUMN 4

Line 43, "denoted," should read --denoted--.
Line 49, "carries" should read --carriers--.
Line 53, "denoted," should read --denoted--.

COLUMN 5

Line 2, "adhesion," should read --adhesion--.
Line 13, "in case" should read --in the case--.

UNITED STATES PATENT AND TRADEMARK OFFICE

CERTIFICATE OF CORRECTION

PATENT NO. : 5,576,133

DATED : November 19, 1996

INVENTOR(S) : YOSHINOBU BABA ET AL.

It is certified that error appears in the above-identified patent and that said Letters Patent is hereby corrected as shown below:

COLUMN 6

Line 3, "emu/$cm^3$" should read --emu/$cm^3$,--.
Line 4, "developing" should read --developer--.
Line 64, "obtain" should read --obtained--.

COLUMN 7

Line 20, "3.0 g/$cm^3$" should read --3.0 g/$cm^3$,--.
Line 44, "Ω.cm, when" should read --Ω.cm. When--.
Line 65, "$cm^2$" should read --$cm^2$,--.

COLUMN 9

Line 5, "or)" should read --$\sigma_r$--.
Line 14, "material." should read --material--.

COLUMN 10

Line 66, "there dimensionally" should read --three-dimensionally--.

COLUMN 11

Line 11, "3000" should read --300--.
Line 29, "for" should read --from--.
Line 54, "by mechanically," should read --mechanically--.
Line 67, "there-dimensionally" should read --three dimensionally--.

UNITED STATES PATENT AND TRADEMARK OFFICE

CERTIFICATE OF CORRECTION

PATENT NO. : 5,576,133

DATED : November 19, 1996

INVENTOR(S) : YOSHINOBU BABA ET AL.

It is certified that error appears in the above-identified patent and that said Letters Patent is hereby corrected as shown below:

COLUMN 12

Line 2, "thereof" should read --thereof,--.
Line 12, "3000" should read --300--.
Line 31, "fro" should read --from--.

COLUMN 13

Line 43, "as shown" should read --shown--.

COLUMN 15

Line 7, "$\mu$m," should read --$\mu$m.--.
Line 14, "$\sigma_r$104" should read --$\sigma_r$=104--.
Line 15,"$\sigma_{300}$122" should read --$\sigma_{300}$=122--.

COLUMN 16

Line 13, "blend" should read --blended--.
Line 54, "$\sigma_r$94 emu/cm$^3$," should read --$\sigma_r$=94 emu/cm$^3$,--.

COLUMN 17

Line 6, "ZnO" should be deleted.
Line 14, "$\sigma_r$2 emu/cm$^3$," should read --$\sigma_r$=2 emu/cm$^3$,--.

UNITED STATES PATENT AND TRADEMARK OFFICE

CERTIFICATE OF CORRECTION

PATENT NO. : 5,576,133

DATED : November 19, 1996

INVENTOR(S) : YOSHINOBU BABA ET AL.

It is certified that error appears in the above-identified patent and that said Letters Patent is hereby corrected as shown below:

COLUMN 18

Line 33, "result" should read --resulting--.
Line 47, "and" should read --and had--.
Line 49, "$\sigma_r$37 emu/cm$^3$, $\sigma_{300}$60 emu/cm$^3$," should read --$\sigma_r$=37 emu/cm$^3$, $\sigma_{300}$=60 emu/cm$^3$,--.

COLUMN 20

Line 10, "images" should read --image--.

COLUMN 21

Line 18, "Then, the" should read --The--.

COLUMN 27

Line 10, "melt-knead" should read --melt-kneaded--.
Line 17, "Then, the" should read --The--.

COLUMN 28

Line 66, "$Fe_2O_3$/ZnO/BaO=70/15/15 by mol" should be deleted.

COLUMN 29

Line 39, "was" (2nd. occ.) should read --were--.

UNITED STATES PATENT AND TRADEMARK OFFICE

CERTIFICATE OF CORRECTION

PATENT NO. : 5,576,133

DATED : November 19, 1996

INVENTOR(S) : YOSHINOBU BABA ET AL.

It is certified that error appears in the above-identified patent and that said Letters Patent is hereby corrected as shown below:

COLUMN 33

Line 39, "$\sigma_r$46 emu/cm$^3$, $\sigma_{300}$51 emu/cm$^3$," should read --$\sigma_r$=46 emu/cm$^3$, $\sigma_{300}$=51 emu/cm$^3$,--.

COLUMN 34

Line 3, "$\sigma_{300}$29 emu/cm$^3$," should read --$\sigma_{300}$=29 emu/cm$^3$,--.
Line 13, "result" should read --resulting--.
Line 23, "blend" should read --blended--.
Line 33, "$\sigma_r$76 emu/cm$^3$," should read --$\sigma_r$=76 emu/cm$^3$,--.
Line 51, "ZnO" should be deleted.
Line 60, "$\sigma_{300}$113 emu/cm$^3$," should read --$\sigma_{300}$=113 emu/cm$^3$,--.

COLUMN 35

Line 23, "$\sigma_{300}$73 emu/cm3," should read --$\sigma_{300}$=73 emu/cm3,--.
Line 36, "nonimage" should read --non-image--.

COLUMN 36

Line 6, "Styrene-acrylic resin 100 wt. parts" should be deleted.
Line 16, "parts" should read --part--.
Line 31, "images" should read --image--.

UNITED STATES PATENT AND TRADEMARK OFFICE

CERTIFICATE OF CORRECTION

PATENT NO. : 5,576,133

DATED : November 19, 1996

INVENTOR(S) : YOSHINOBU BABA ET AL.

It is certified that error appears in the above-identified patent and that said Letters Patent is hereby corrected as shown below:

COLUMN 37

Line 41, "Se" should read --Se,--.
Line 67, "have" should read --having-- and "is" should read --are--.

COLUMN 38

Line 25, "having" should read --have--.

COLUMN 39

Line 11, "Se" should read --Se,--.
Line 35, "$|\sigma_{1000}-\sigma_{300}-|\sigma_{1000}$" should read --$|\sigma_{1000}-\sigma_{300}-|/\sigma_{1000}$--.
Line 43, "having" should read --have--.

COLUMN 40

Line 36, "Se" should read --Se,--.

UNITED STATES PATENT AND TRADEMARK OFFICE

CERTIFICATE OF CORRECTION

PATENT NO. : 5,576,133

DATED : November 19, 1996

INVENTOR(S) : YOSHINOBU BABA ET AL.

It is certified that error appears in the above-identified patent and that said Letters Patent is hereby corrected as shown below:

COLUMN 41

Line 7, "having" should read --have--.
Line 14, "claim 57," should read --claim 54,--.

Signed and Sealed this

Ninth Day of September, 1997

*Attest:*

Bruce Lehman

BRUCE LEHMAN

*Attesting Officer*

*Commissioner of Patents and Trademarks*